US008505752B2

(12) United States Patent
Shinozaki

(10) Patent No.: US 8,505,752 B2
(45) Date of Patent: Aug. 13, 2013

(54) RACK ASSEMBLY

(75) Inventor: Takashi Shinozaki, Tokyo (JP)

(73) Assignee: Kawajun Co., Ltd., Tokyo (JP)

( * ) Notice: Subject to any disclaimer, the term of this patent is extended or adjusted under 35 U.S.C. 154(b) by 0 days.

(21) Appl. No.: 13/401,636

(22) Filed: Feb. 21, 2012

(65) Prior Publication Data

US 2012/0234786 A1 Sep. 20, 2012

Related U.S. Application Data

(62) Division of application No. 12/991,159, filed as application No. PCT/JP2009/071514 on Dec. 17, 2009, now Pat. No. 8,118,181.

(30) Foreign Application Priority Data

Dec. 24, 2008 (JP) ..... 2008-327287
Mar. 31, 2009 (JP) ..... 2009-084215

(51) Int. Cl.
*A47B 57/00* (2006.01)

(52) U.S. Cl.
USPC ..... 211/187; 211/208; 108/147.13

(58) Field of Classification Search
USPC ..... 211/189, 190, 194, 191, 192, 134, 211/186, 187, 188, 153, 119.003, 208; 108/147.11–147.18, 107; 312/265.1–265.5
See application file for complete search history.

(56) References Cited

U.S. PATENT DOCUMENTS 3,642,146 A 2/1972 Frazier
4,593,826 A * 6/1986 Bustos ..... 211/187
4,595,107 A * 6/1986 Welsch ..... 211/187
4,627,543 A * 12/1986 Nicely ..... 211/187

(Continued)

FOREIGN PATENT DOCUMENTS

DE 2049286 A1 10/1971
EP 1878359 A1 1/2008

(Continued)

OTHER PUBLICATIONS

Extended European Search Report, directed to PCT/JP2009/071514, mailed on Oct. 7, 2011, 5 pages.

(Continued)

*Primary Examiner* — Joshua J Michener
*Assistant Examiner* — Stanton L Krycinski
(74) *Attorney, Agent, or Firm* — Smith Patent Office

(57) ABSTRACT

An assembly shelf includes a post that includes two main post sections and a connection section that connects the main post sections, a plurality of through-holes being formed in the connection section along a longitudinal direction, a pair of connection members, each of the pair of connection members including a first engagement section that engages the post, and a second engagement section that engages a shelf board member, and a shelf board member that includes a third engagement section that is formed approximately at each corner and engages the second engagement section, the pair of connection members and the shelf board member being positioned within the range that corresponds to half of the post in the lateral direction.

10 Claims, 25 Drawing Sheets

(56) References Cited

U.S. PATENT DOCUMENTS

| | | | | | |
|---|---|---|---|---|---|
| 4,706,576 | A | * | 11/1987 | James | 108/192 |
| D382,736 | S | * | 8/1997 | Kopish | D6/495 |
| 5,695,081 | A | * | 12/1997 | Alkalay | 211/187 |
| D418,394 | S | * | 1/2000 | King | D8/354 |
| 6,068,143 | A | * | 5/2000 | Wang | 211/187 |
| 6,138,843 | A | * | 10/2000 | Nicolai et al. | 211/183 |
| 6,253,933 | B1 | * | 7/2001 | Yang | 211/187 |
| 6,357,611 | B1 | * | 3/2002 | Chen | 211/187 |
| 6,364,138 | B1 | | 4/2002 | Chen | |
| 6,726,040 | B1 | * | 4/2004 | Chen | 211/187 |
| 7,093,728 | B2 | * | 8/2006 | Chen | 211/187 |
| 7,478,971 | B2 | * | 1/2009 | Li | 403/398 |
| 2002/0046982 | A1 | * | 4/2002 | Guizzardi | 211/187 |
| 2010/0089852 | A1 | * | 4/2010 | Wang | 211/153 |
| 2010/0155352 | A1 | * | 6/2010 | Hsieh | 211/134 |

FOREIGN PATENT DOCUMENTS

| | | | |
|---|---|---|---|
| GB | 1387741 | A | 3/1975 |
| JP | 3057990 | U | 3/1993 |
| JP | 3054076 | U | 9/1998 |
| JP | 3066571 | U | 12/1999 |
| JP | 3104160 | U | 6/2004 |
| JP | 2007-159947 | A | 6/2007 |

OTHER PUBLICATIONS

International Search Report, directed to PCT/JP2009/071514, mailed on Mar. 23, 2010, 2 pages.

European Office Action, directed to EP Application No. 09834985.5 mailed on Feb. 8, 2013, 4 pages.

* cited by examiner

RACK ASSEMBLY

CROSS REFERENCE TO RELATED APPLICATIONS

This application is a divisional application of U.S. patent application Ser. No. 12/991,159 filed on Nov. 5, 2010 now U.S. Pat. No. 8,118,181, and expected to issue as U.S. Pat. No. 8,118,181 on Feb. 21, 2012, which claims priority to PCT International Application No. PCT/JP2009/071514 filed on Dec. 17, 2009 and Japanese Patent Application No. 2009-084215 filed on Mar. 31, 2009 and Japanese Patent Application No. 2008-327287 filed on Dec. 24, 2008. The disclosures of U.S. patent application Ser. No. 12/991,159 and PCT International Application No. PCT/JP2009/071514 and Japanese Patent Application Nos. 2008-327287 and 2009-084215 are hereby incorporated by reference.

BACKGROUND OF THE INVENTION

1. Technical Field

The present invention relates to an assembly shelf that may be used as a storage shelf that is installed in an office, home, warehouse, store, and the like, or may be used as a display shelf that is installed in a store, and implements easy assembly and disassembly.

2. Background Art

Publication of Registered Japanese Utility Model Application No. 3057990 discloses a shelf board locking structure that includes a post in which a plurality of annular locking grooves are formed in its outer circumferential surface in the longitudinal direction at given intervals, a tapered sleeve that is attached to the outer circumferential surface of the post in a state in which a protrusion formed on the inner circumferential surface is fitted into the locking groove of the post, and is formed so that the diameter of the external shape thereof gradually increases downward, and a shelf board that has an inner surface shape that gradually increases in diameter downward to approximately coincide with part or the entirety of the outer surface shape of the tapered sleeve, and has a ring that is provided at each corner and is disposed around the outer circumferential surface of the tapered sleeve that is attached to the outer circumferential surface of the post, wherein the right and left rings of the shelf board differ in height, and are alternately disposed around the outer circumferential surface of the tapered sleeve, and right and left shelf boards can be connected by utilizing a single post.

Publication of Registered Japanese Utility Model Application No. 3066571 discloses a metal rack that includes four posts in which grooves are formed in the circumferential direction at equal intervals, and a shelf, and utilizes a tapered sleeve that that can be vertically divided in two, includes a protrusion that extends in the circumferential direction and is fitted into a groove that is formed in the post and extends in the circumferential direction, and is secured at an appropriate position in the direction of the height of the post, and a tapered sleeve that has a vertical cut so that the post can be inserted into the tapered sleeve from the side, and is disposed over the tapered sleeve that is secured on the post, wherein the shelf is installed by integrally securing the tapered sleeve on part of the shelf, and disposing the secured tapered sleeve over the tapered sleeve that is secured on the post, the shelf may be a shelf that integrally includes a crosspiece and a tabular shelf main body, wherein a tapered sleeve is secured at each corner of the crosspiece, a shelf that includes a pair of crosspieces on which a tapered sleeve is secured at each end in the longitudinal direction and which are suspended on the posts in the widthwise direction of the rack, and a shelf main body that is separately formed from the crosspieces, is suspended on the crosspieces movably in the longitudinal direction, and has a width equal to half the total width of the shelf, and a shelf that includes a pair of crosspieces on which a tapered sleeve is secured at each end in the longitudinal direction and which are suspended on the posts in the widthwise direction of the rack, and a shelf main body that is separately formed from the crosspieces, is suspended on the crosspieces movably in the longitudinal direction, and has a length equal to half the length of the shelf, and these shelves are appropriately used in combination.

According to the above assembly shelves, a single post can be shared when connecting two shelf board members in the longitudinal direction. This implements easy assembly while providing a good design.

(Patent Document 1) Publication of Registered Japanese Utility Model Application No. 3057990

(Patent Document 2) Publication of Registered Japanese Utility Model Application No. 3066571

DISCLOSURE OF THE INVENTION

Problems to be Solved by the Invention

According to the above assembly shelves, however, when it is desired to change the position of a middle shelf board member of a multi-stage assembly (hereinafter may be referred to as "middle shelf board removal operation"), it is necessary to remove the shelf board member that is positioned above the middle shelf board member. Therefore, the middle shelf board removal operation causes inconvenience to the user although assembly is easy.

Accordingly, an object of the present invention is to provide an assembly shelf that can be easily assembled, and allows only a middle shelf board member to be removed and reinstalled without removing other shelf board members when changing the position of a middle shelf board member of a multi-stage assembly.

Means for Solving the Problems

Specifically, the present invention solves the above problems, and provides an assembly shelf comprising: a post that includes two main post sections and a connection section that connects the two main post sections, the post having a symmetrical shape with respect to a post axis, a plurality of through-holes or engagement elevations and depressions being formed in the connection section along a longitudinal direction at regular or irregular intervals; a pair of connection members, each of the pair of connection members including a first engagement section that engages the post, and a second engagement section that engages a shelf board member, the pair of connection members being attached to hold either side of the post utilizing a range that corresponds to half of the post in a lateral direction; and a shelf board member that includes a third engagement section that is formed approximately at each corner and engages the second engagement section, the pair of connection members and the shelf board member being secured on the post within the range that corresponds to half of the post in the lateral direction.

The present invention also provides an assembly shelf comprising: four posts, each of the four posts including two main post sections and a connection section that connects the two main post sections, and having a symmetrical shape with respect to a post axis, a plurality of engagement protrusions or engagement depressions being formed on each side of each of the two main post sections along a longitudinal direction at regular or irregular intervals; a pair of connection members, each of the pair of connection members including an engagement depression or an engagement protrusion that engages one of the plurality of engagement protrusions or engagement depressions, a first engagement section that comes in contact with a side surface of one of the four posts, and a second engagement section that engages a shelf board member, the pair of connection members being attached to hold either side of one of the four posts utilizing a range that corresponds to half of the post in a lateral direction; and a shelf board member that includes a third engagement section that is formed approximately at each corner and engages the second engagement section, the pair of connection members and the shelf board member being secured on one of the four posts within the range that corresponds to half of the post in the lateral direction.

Effects of the Invention

The assembly shelf according to the present invention can be easily assembled, and allows only a middle shelf board member to be removed and reinstalled without removing other shelf board members when changing the position of a middle shelf board member of a multi-stage assembly.

BEST MODE FOR CARRYING OUT THE INVENTION

Figure 1:
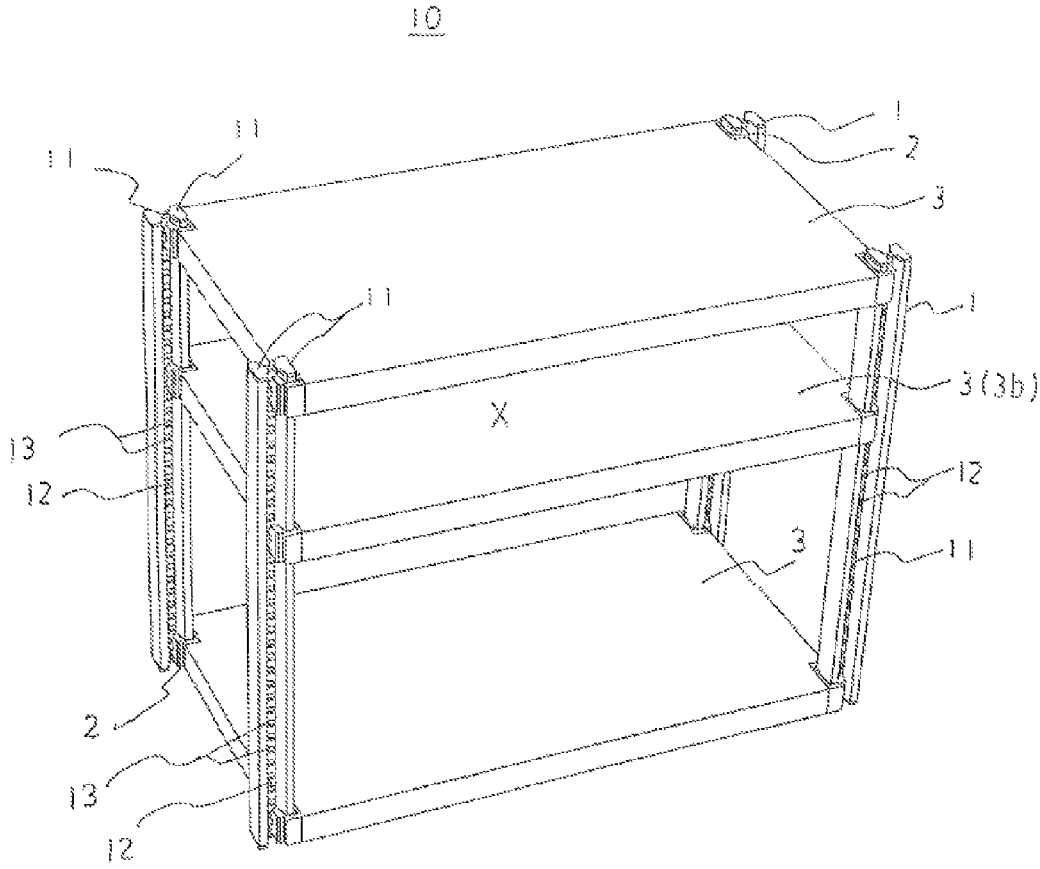
FIG. 1 is a perspective view showing an assembly shelf according to a first embodiment.
Figure 2:
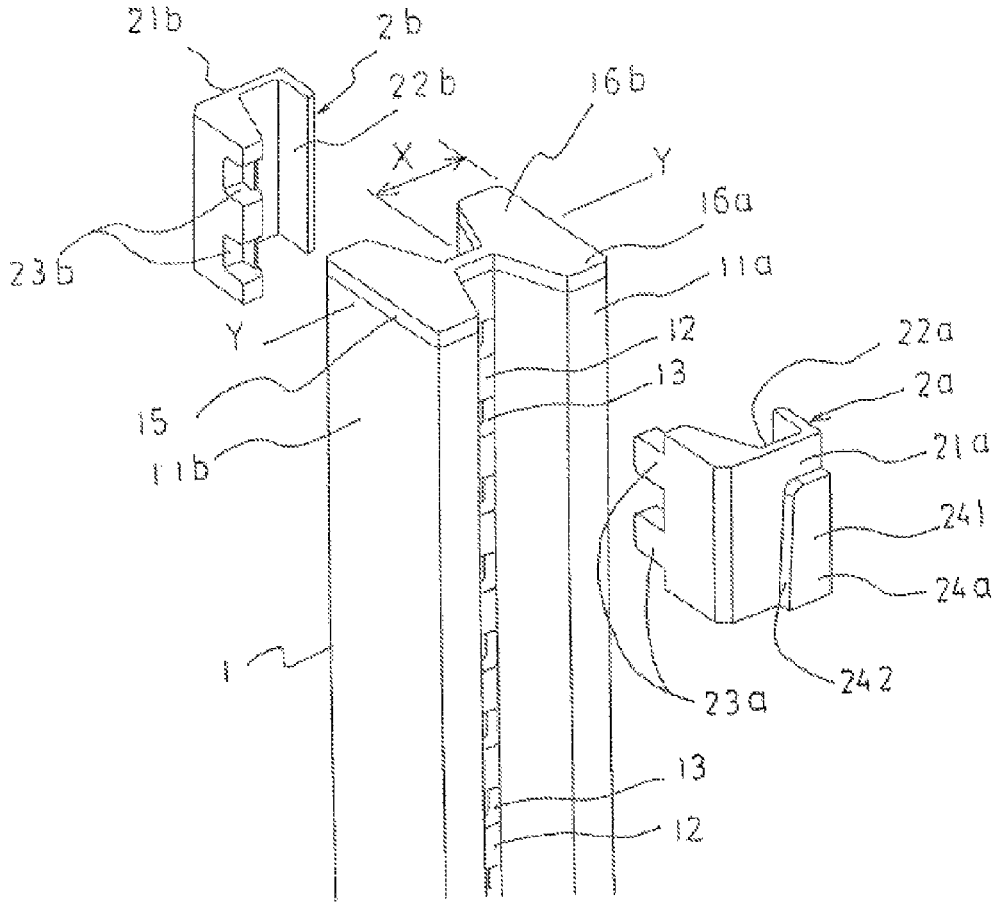
FIG. 2 is a perspective view showing a post and a pair of connection members before assembly.

An assembly shelf according to a first embodiment of the present invention is described below with reference to FIGS. 1 to 5. An assembly shelf 10 includes a post 1, a pair of connection members 2, and a shelf board member 3. A single shelf board member 3 is secured on four posts 1 using four pairs of connection members. Therefore, the three-stage assembly shelf 10 shown in FIG. 1 includes three shelf board members 3, four posts 1, and twelve pairs of connection members. Note that twelve pairs of connection members include twenty-four connection members.

The post 1 includes two main post sections 11 (11*a*, 11*b*) and a connection section 12 that connects the main post sections 11. The post 1 has a symmetrical shape with respect to a post axis (i.e., a virtual vertical axis positioned at the center of the connection section). The post 1 has a line-symmetrical shape with respect to the post axis in the longitudinal direction and the lateral direction of the shelf board member during use. The planar shape of the main post section 11 is not particularly limited. In this embodiment, the main post section 11 has an approximately pentagonal planar shape that is flattened to some extent. The length of the main post section 11 in the vertical direction (longitudinal direction) is appropriately determined depending on the number of stages and the like. The main post section 11 provides the post 1 with strength, and allows the connection member 2 to be easily fitted to the post 1. The main post section 11 may be solid or hollow. It is preferable that the main post section 11 be hollow so that a reduction in weight can be achieved while ensuring high strength. Note that reference numeral 15 shown in FIG. 2 indicates a cap that is fitted into the hollow body.

The connection section 12 is a plate-like member that has a given width and a given thickness. A plurality of through-holes 13 are formed in the connection section 12 in the longitudinal direction (vertical direction) at regular or irregular intervals. The through-hole 13 enables installation of the connection member 2, and serves as a guide (standard) for the installation position of the shelf board member. The thickness of the connection section 12 is appropriately determined so that the post 1 exhibits a sufficient strength. Since protrusions 23*a* of two connection members 2 are inserted into the through-hole 13, the width of the connection section 12 is appropriately determined depending on the thickness of the protrusion 23*a* of the connection member 2. The through-hole 13 may be a round hole, a rectangular hole, an elliptical hole, or the like. In this embodiment, a plurality of rectangular through-holes 13 are formed in the connection section 12 at a constant pitch.

The assembly shelf 10 shown in FIG. 1 forms one unit (normally a multi-stage unit). A pair of connection members 2 and the shelf board member 3 are positioned within a range that corresponds to half of the post 1 in the lateral direction (i.e., a direction along the line Y-Y in FIG. 2 (longitudinal direction when viewed from above). Specifically, a pair of connection members 2 and the shelf board member 3 are disposed within a range (i.e., a range X shown in FIG. 2) that covers one main post section 11*a* and half of the through-hole 13 that is positioned on the side of the main post section 11*a*. Therefore, when connecting two assembly shelves 10 in the direction along the line Y-Y, one post 1 can be shared when securing the right and left shelf board members 3 and 3 (see FIGS. 4 and 5).

Each of a pair of connection members 2*a* and 2*b* includes a first engagement section that engages the post 1, and a second engagement section that engages the shelf board member 3, and is installed so that the connection members 2*a* and 2*b* hold either side of the post 1 by utilizing half of the post 1 in the lateral direction. The connection members 2*a* and 2*b* shown in FIG. 2 differ in shape. The connection member 2*a* has a given height (vertical dimension), and is approximately formed in the shape of the letter "C" when viewed from above. The connection member 2*a* includes a depression 22*a* that has a shape corresponding to the shape of a side surface 16*a* of a main post section 11*a*, and a protrusion 23*a* that is positioned adjacent to the depression 22*a* and is inserted into the through-hole 13. Specifically, the first engagement section includes the depression 22*a* that encloses the side area of the main post section 11*a*, and the protrusion 23*a* that is inserted into the through-hole 13. The protrusion 23*a* according to this embodiment includes arm sections 23*a* that have an approximately rectangular cross-sectional shape and extend perpendicularly to a backboard 21*a* that is approximately formed in the shape of the letter "C" from one end (i.e., an end that is positioned on the inner side of the post 1) of the backboard 21*a*. The arm sections 23*a* are fitted into two through-holes 13 that are adjacent in the vertical direction. The thickness (i.e., horizontal dimension) of the arm sections 23*a* is half that of the through-hole 13. The height (i.e., vertical dimension) of the arm sections 23*a* is approximately equal to that of the through-hole 13.

A sheet-shaped section (protrusion) (i.e., second engagement section) 24*a* is formed on the outer side of the backboard 21*a* (i.e., on the side of the shelf board member). The second engagement section 24*a* includes a side slope 242 that gradually increases in dimension downward, and a rear slope 241 that gradually increases in dimension downward. Note that the inclination angle of the rear slope 241 is lower than that of the side slope 242. The end face of the second engagement section 24*a* on the side of the shelf board member is flush with the end face of the connection member 2*a* on the side of the shelf board member.

The connection member 2*b* has a given height, and is formed in the shape of a letter "C" when viewed from above. The connection member 2*b* includes a depression 22*b* that has a shape corresponding to the shape of a side surface 16*b* of the main post section 11*a*, and two depressions 23*b* (second depression) that are positioned adjacent to the depression 22*b* and engage the arm sections 23*a* of the connection member 2*a*. Specifically, the first engagement section of the connection member 2*b* is the depression 22*b* that comes in contact with a side surface 16*b* of the main post section 11*a*. The second depressions 23*b* are shaped to closely engage the arm sections 23*a*. Specifically, the second depressions 23*b* have an approximately rectangular cross-sectional shape, and are open on the side where the second depressions 23*b* engage the arm sections 23*a* and 23*a* and the side opposite to the shelf board member in the direction along the line Y-Y.

A sheet-shaped section (protrusion) (i.e., second engagement section) 24*b* (not shown) is formed on the outer side of the backboard 21*b* (i.e., on the side of the shelf board member) in the same manner as the connection member 2*a*. The shape of the second engagement section 24*b* is the same as that of the second engagement section 24*a* of the connection member 2*a*. The height of the connection members 2*a* and 2*b* (i.e., vertical dimension) is the same as the height (i.e., thickness) of the shelf board member 3.

Figure 3:
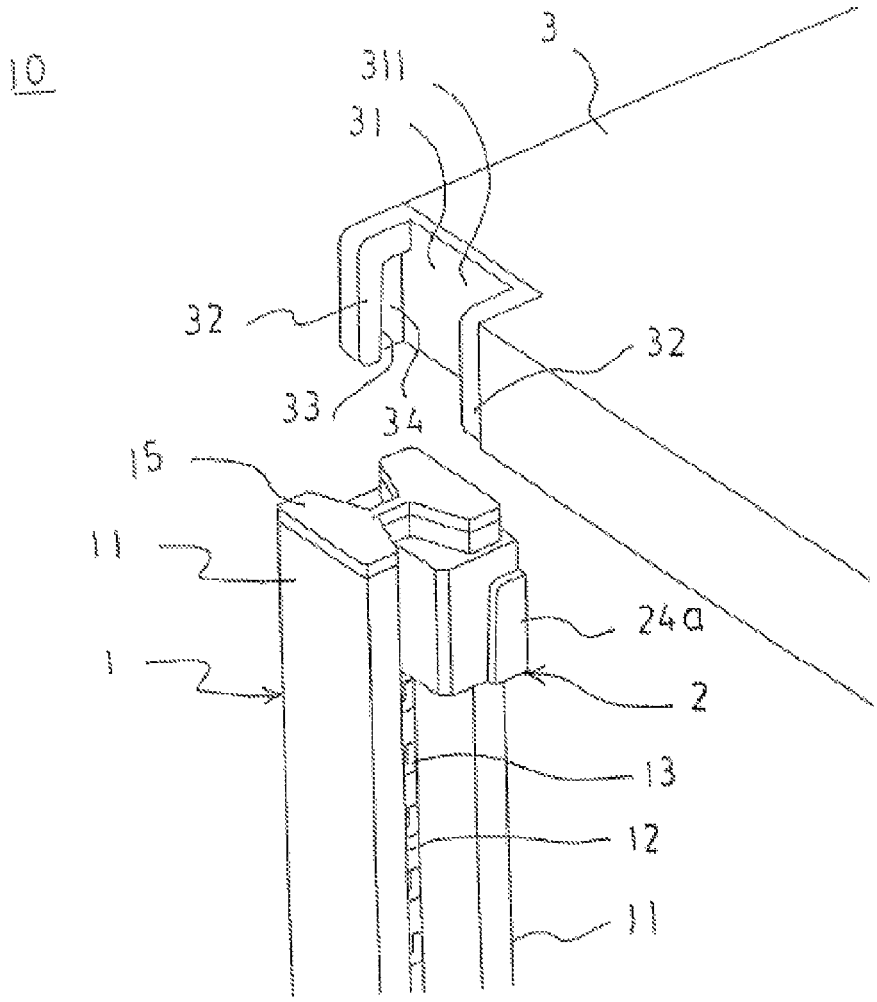
FIG. 3 is a view illustrative of installation of a shelf board member.

The connection members 2*a* and 2*b* are secured on the post 1 as follows. Specifically, the arm sections 23*a* of the connection member 2*a* are inserted into two through-holes 13 that are located at positions at which it is desired to install the shelf board member 3, and the depression 22*a* of the connection member 2*a* is fitted onto the side surface 16*a* of the main post section 11*a*. The second depressions 23*b* of the connection member 2*b* are then fitted onto the arm sections 23*a* so that the connection members 2*a* and 2*b* are joined (integrated) (FIG. 3). Almost no opening is formed between the connection members 2*a* and 2*b* and the post 1 (i.e., the connection members 2*a* and 2*b* and the post 1 are joined (integrated)). Specifically, the connection members 2*a* and 2*b* and the post 1 are joined to form a box-shaped body that is formed within a range that covers half of the post 1 in the lateral direction. The sheet-shaped sections (protrusions) 24*a* and 24*b* are provided on either side of the box-shaped body.

The shelf board member 3 includes a third engagement section 31 that is formed approximately at each corner and engages the sheet-shaped sections (protrusions) 24*a* and 24*b* (second engagement section). The term "each corner" used in this embodiment refers to each end of the shelf board member 3 in the lateral direction. This makes it possible to install the assembly shelf 10 in a stable manner due to an increase in installation area formed by four posts. The main area of the shelf board member may have a board-like structure or a net-like structure. It is preferable that the main area of the shelf board member have a board-like structure so that the third engagement section 31 can be easily formed.

Figure 5:
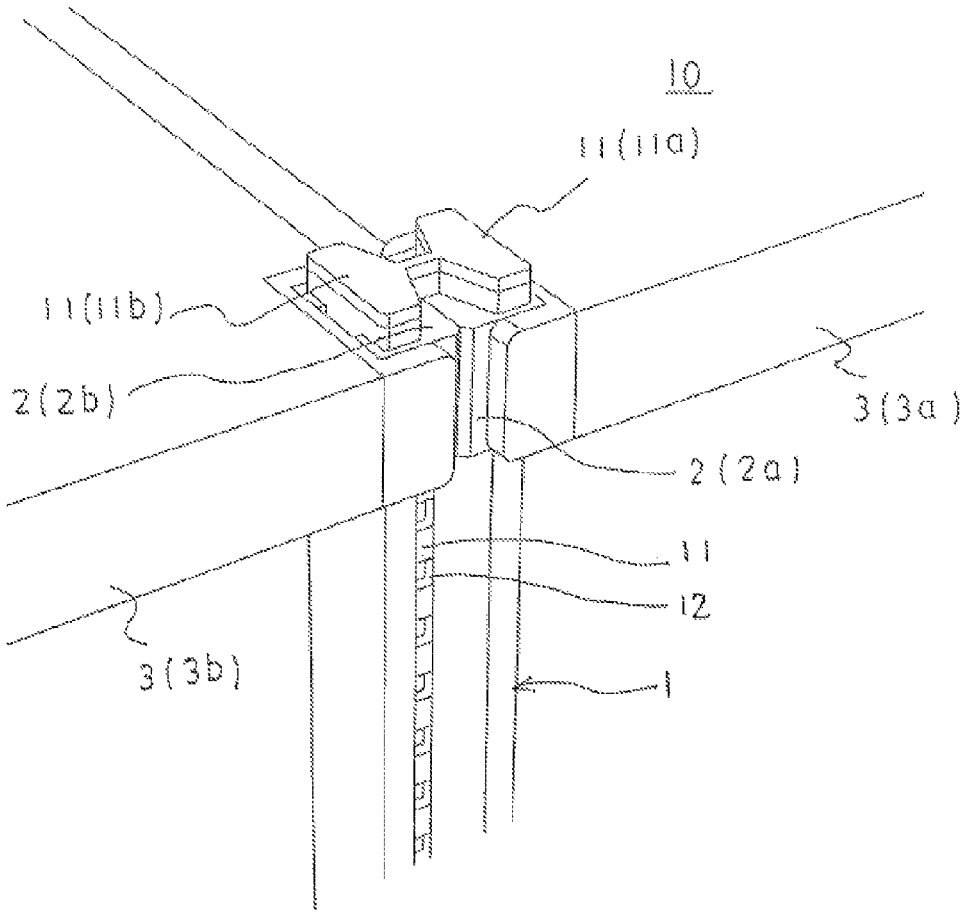
FIG. 5 is an enlarged view showing the middle connection area of the assembly shelf shown in FIG. 4.

The third engagement section 31 of the shelf board member 3 is formed by forming a space 311 that receives the box-shaped body formed by the connection members 2*a* and 2*b* and the post 1 by removing the shelf board member 3, and forming a space 34 that receives the sheet-shaped section 24*a* or 24*b* on either side of the space 311. Specifically, a slope 33 that is formed on the front side of each (right or left) small space of the third engagement section 31 gradually increases in dimension downward, and a side surface 34 of the small space gradually increases in dimension downward. The third engagement section 31 of the shelf board member 3 is formed at an interval from the end face of the shelf board member 1 in the lateral direction. When the third engagement section 31 of the shelf board member 3 is fitted onto the second engagement sections 24*a* and 24*b*, the tapered sections of the second engagement sections 24*a* and 24*b* are fitted into the tapered sections of the third engagement section 31 so that the third engagement section 31 is firmly secured on the second engagement sections 24*a* and 24*b*. The upper wall that defines the depression that forms the small space comes in contact with the upper side of the sheet-shaped section 24*a*, so that the downward movement of the shelf board member 3 stops (i.e., the shelf board member 3 is positioned in the vertical direction), and the connection members 2*a* and 2*b* are reliably joined (FIG. 5).

Figure 4:
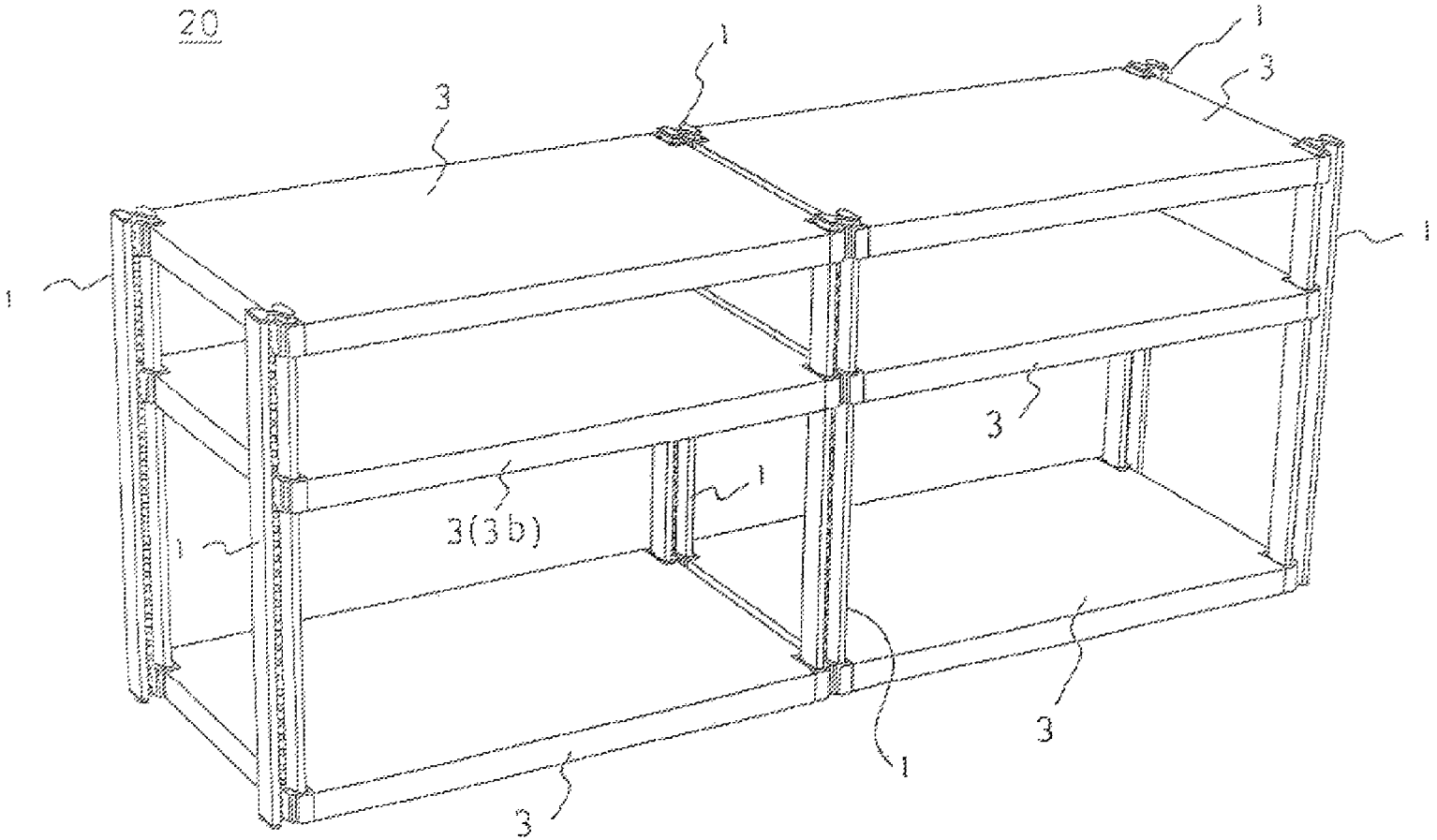
FIG. 4 is a perspective view showing an assembly shelf formed by connecting shelf board members in the longitudinal direction.

A shelf board member and connection members having the same shape as described above may be fitted to the remaining half area of the post 1 of the assembly shelf 10 so that two shelf board members 3 are connected via a single post 1. An assembly shelf 20 may thus be formed. Specifically, the assembly shelf 20 shown in FIG. 4 is a double assembly shelf in which the shelf board members 3 are provided on either side of a single post 1. The assembly shelf 20 differs from the assembly shelf 10 as to the usage of the middle post 1. As shown in FIGS. 3 and 5, a shelf board member 3 and a pair of connection members 2*a* and 2*b* are fitted to the remaining half area of the post 1 of the assembly shelf 10. The shelf board member 3 and the connection members 2*a* and 2*b* additionally used for the assembly shelf 20 and their installation methods are the same as described above in connection with the assembly shelf 10. A triple assembly shelf or the like may be formed in the same manner as described above.

Figure 16:
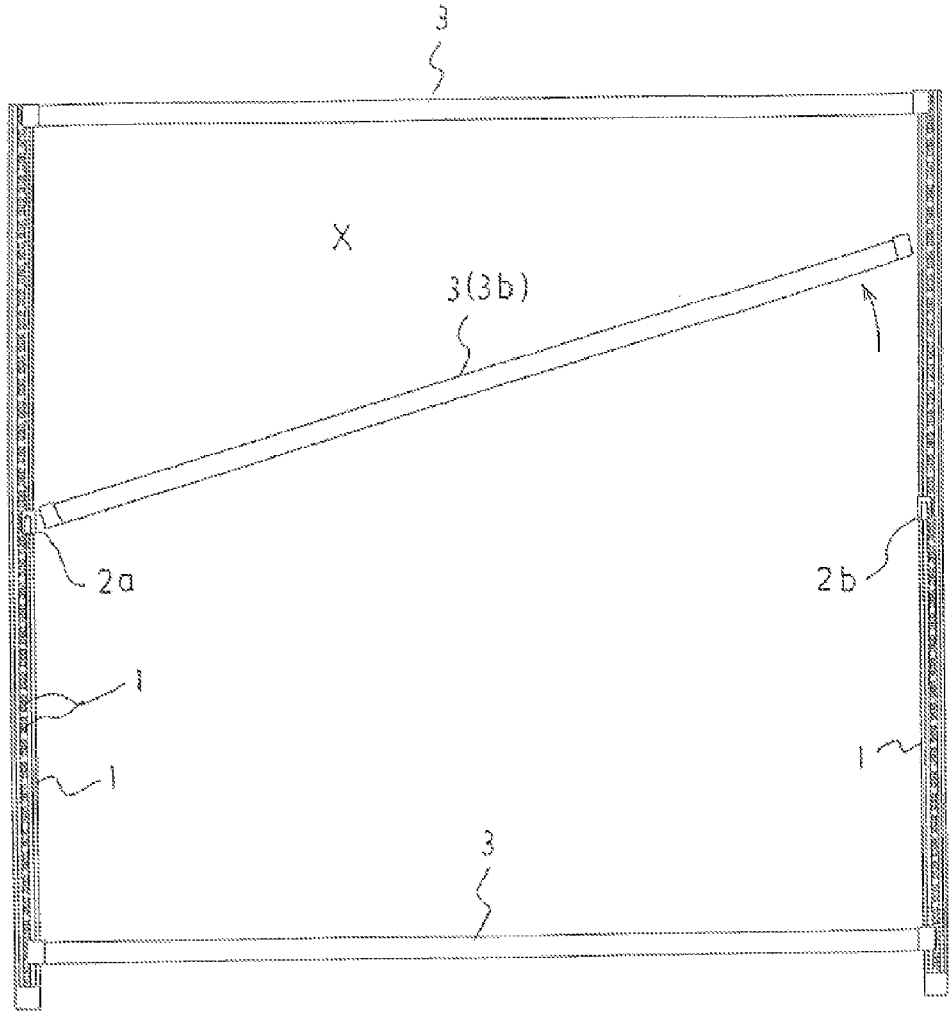
FIG. 16 is a view illustrative of a middle shelf board removal operation.
Figure 17:
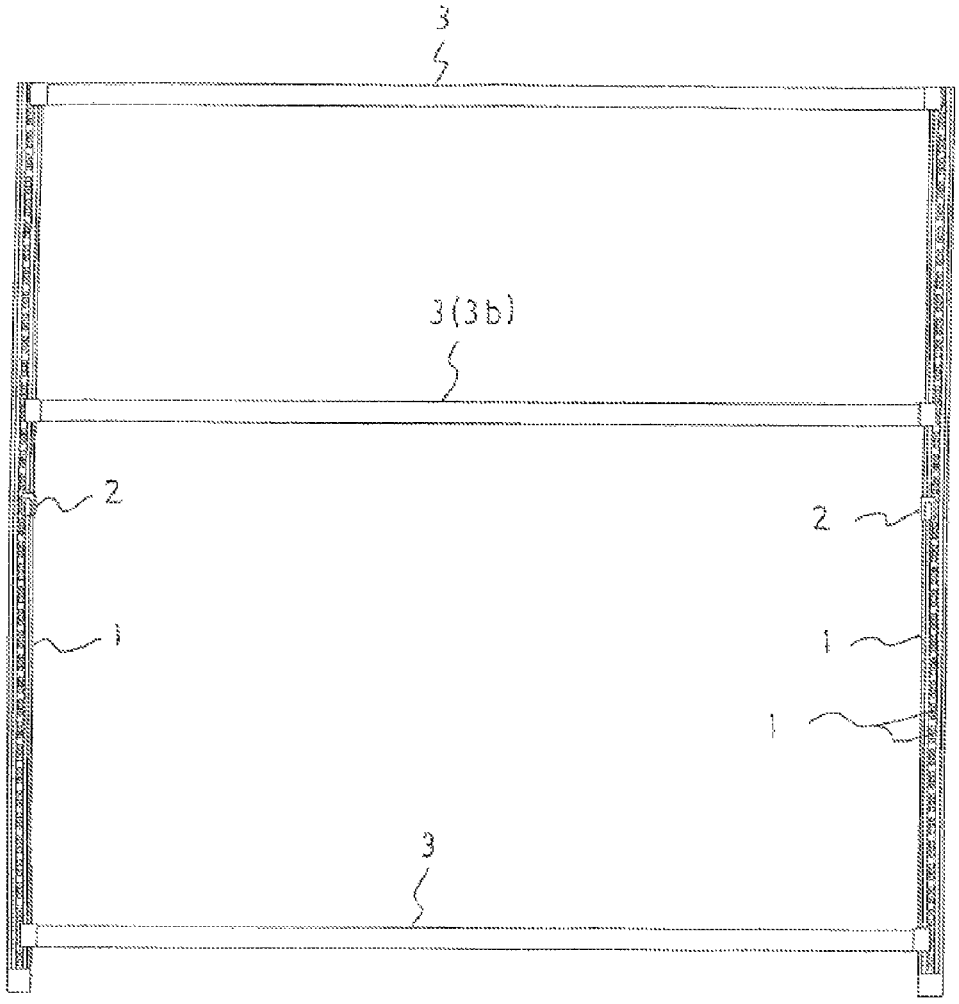
FIG. 17 is a view showing a state in which a middle shelf board has been reinstalled after a middle shelf board removal operation.

A case of removing a middle shelf board member 3*b* of the assembly shelf 10 or 20, or changing the installation position of the middle shelf board member 3*b* (i.e., middle shelf board removal operation) is described below with reference to FIGS. 1, 16, and 17. In FIG. 16, the middle shelf board member 3*b* is moved upward in order to remove the middle shelf board member 3*b*. An obstacle that may hinder the movement of the middle shelf board member 3*b* is not present in a space X above the middle shelf board member 3*b*, and a sufficient space is formed between the post 1 and the third engagement section 31 of the shelf board member 3 at a position where the connection member 2*a* or 2*b* is not secured on the post 1. When the middle shelf board member 3*b* has been moved upward to some extent, the middle shelf board member 3*b* is inclined upward or downward along the longitudinal direction (see FIG. 16). The middle shelf board member 3*b* is inclined so that the horizontal dimension of the inclined middle shelf board member 3*b* is smaller than the distance between the posts 1 of the assembly shelf 10. The middle shelf board member 3*b* thus inclined is then removed forward from the assembly shelf 10. After removing the middle shelf board member 3*b*, the connection members 2*a* and 2*b* may be removed from the assembly shelf 10, and may optionally be secured at different positions of the assembly shelf 10. The middle shelf board member 3*b* may be installed by performing the above steps in the reverse order. FIG. 17 shows a state in which the middle shelf board member 3*b* has been reinstalled. The assembly shelves 10 and 20 thus allow an easy middle shelf board removal operation. Note that the configuration shown in FIGS. 16 and 17 differs from the configuration shown in FIG. 1 as to the shape of the through-holes 13. In FIGS. 16 and 17, a number of through-hole groups are formed at a given pitch in the vertical direction (i.e., the longitudinal direction of the post 1), each of the through-hole groups including three adjacent through-holes 13.

Figure 9:
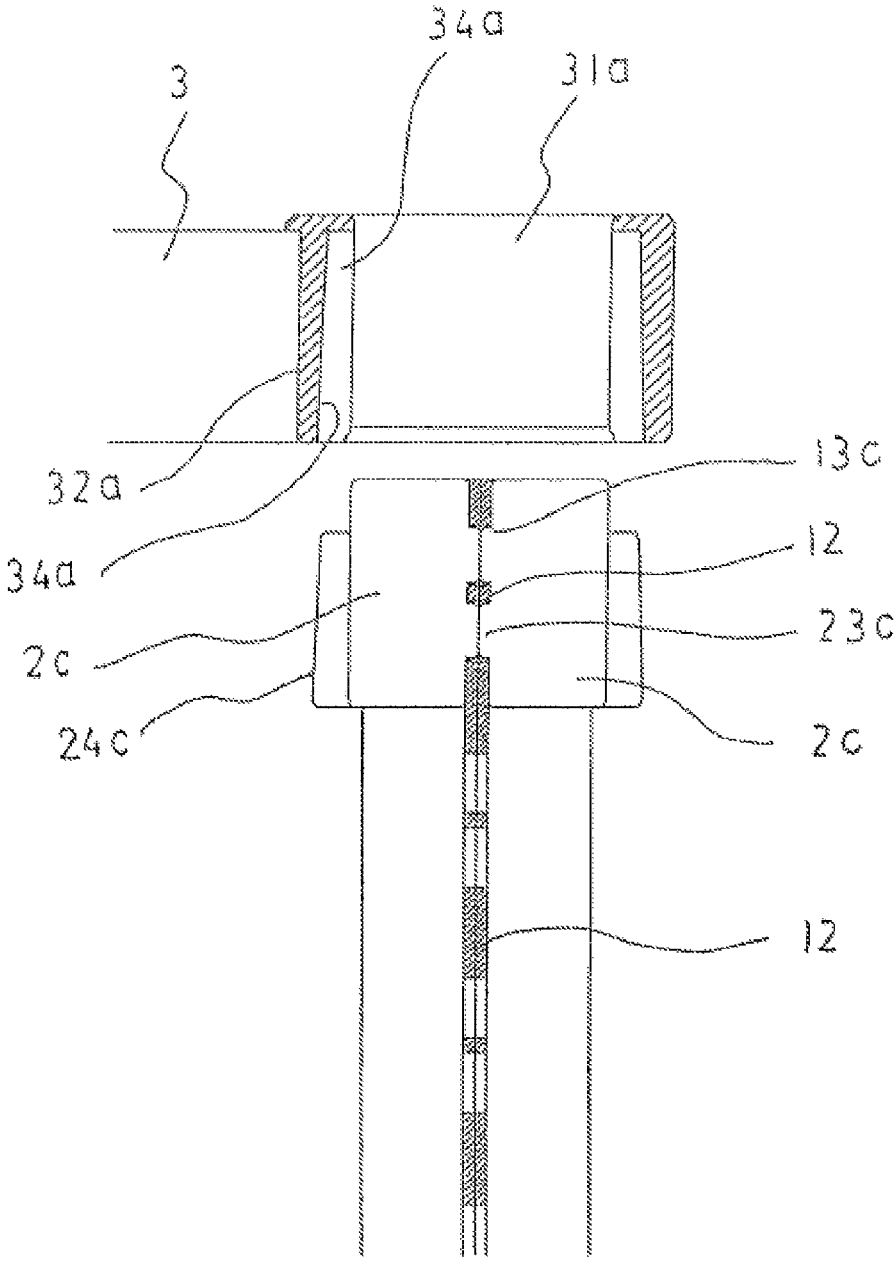
FIG. 9 is a cross-sectional view showing the shelf board member shown in FIG. 8 along the lateral direction.
Figure 10:
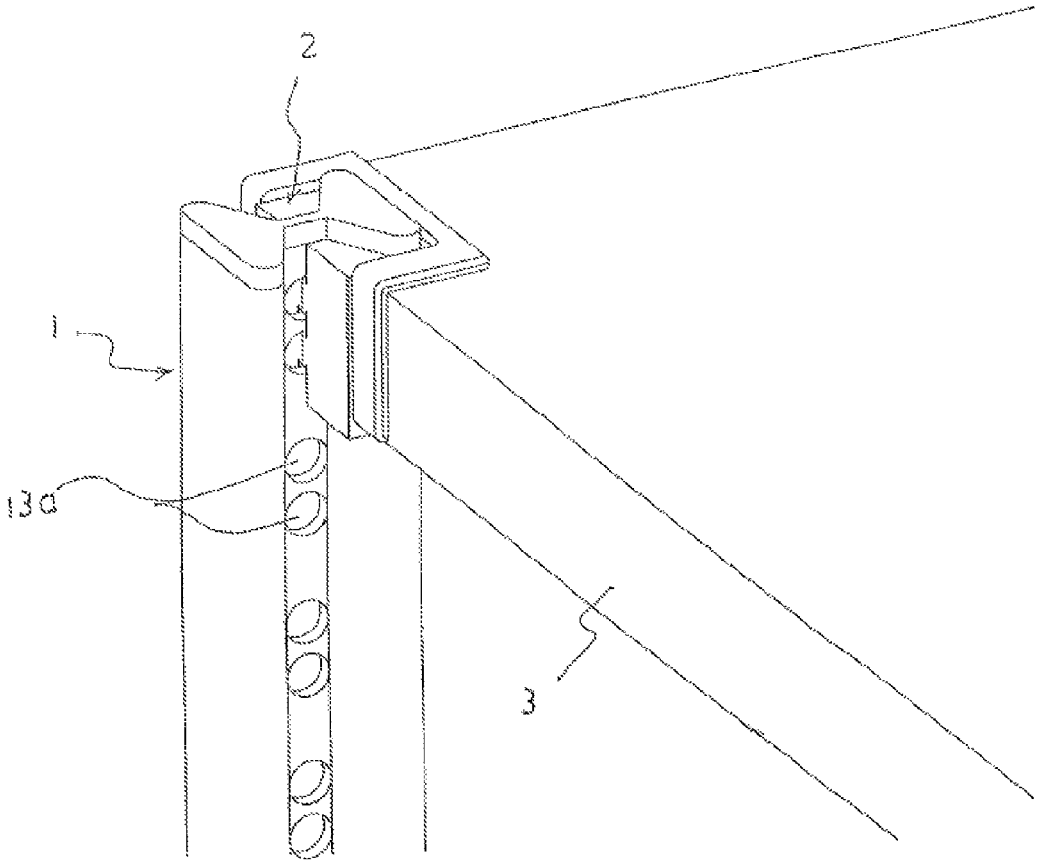
FIG. 10 is an enlarged perspective view showing an engagement area of a post.

An assembly shelf according to a second embodiment of the present invention is described below with reference to FIGS. 6 to 11. Note that the engagement area shown in FIGS. 9 and 11 is positioned diagonally with respect to the engagement area shown in FIG. 8.

Figure 6:
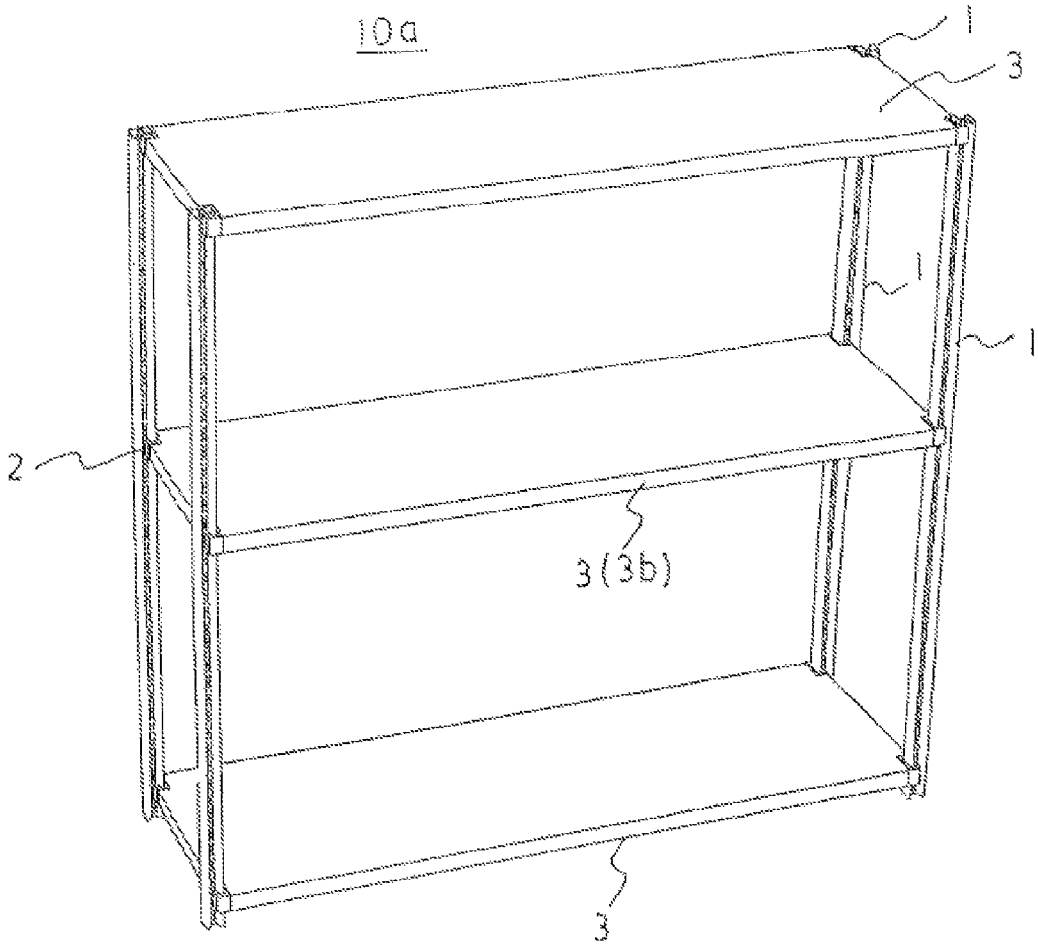
FIG. 6 is a perspective view showing an assembly shelf according to a second embodiment.
Figure 7:
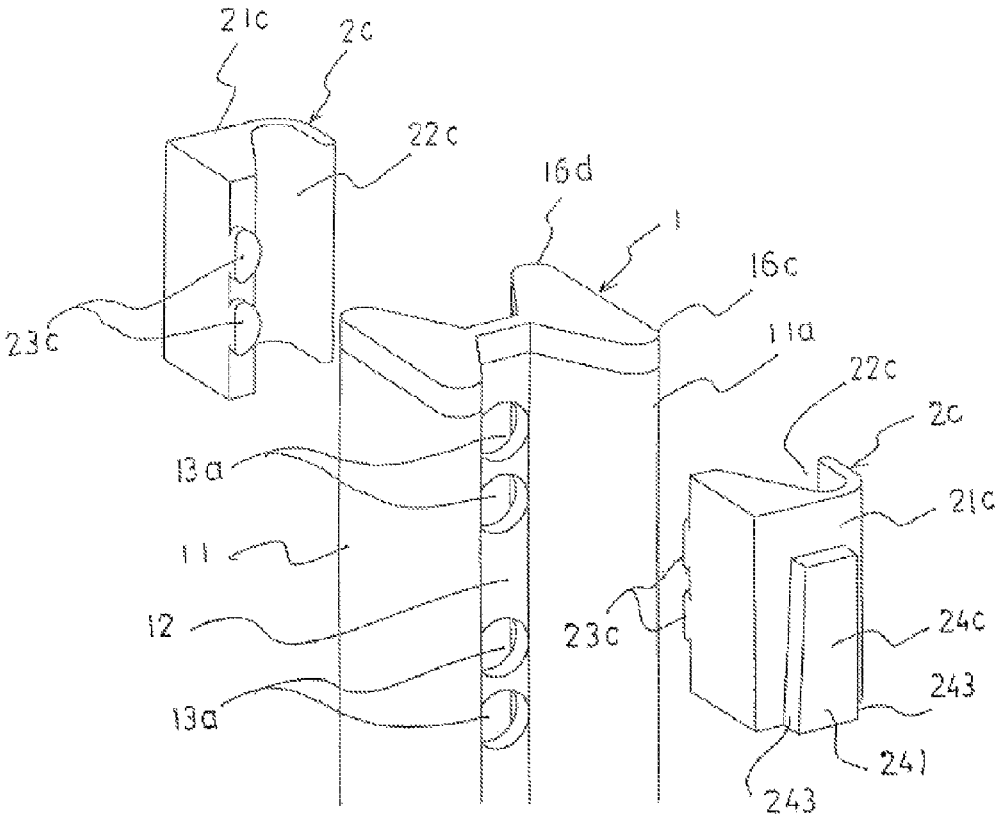
FIG. 7 is a perspective view showing a post and a pair of connection members before assembly according to the second embodiment.
Figure 8:
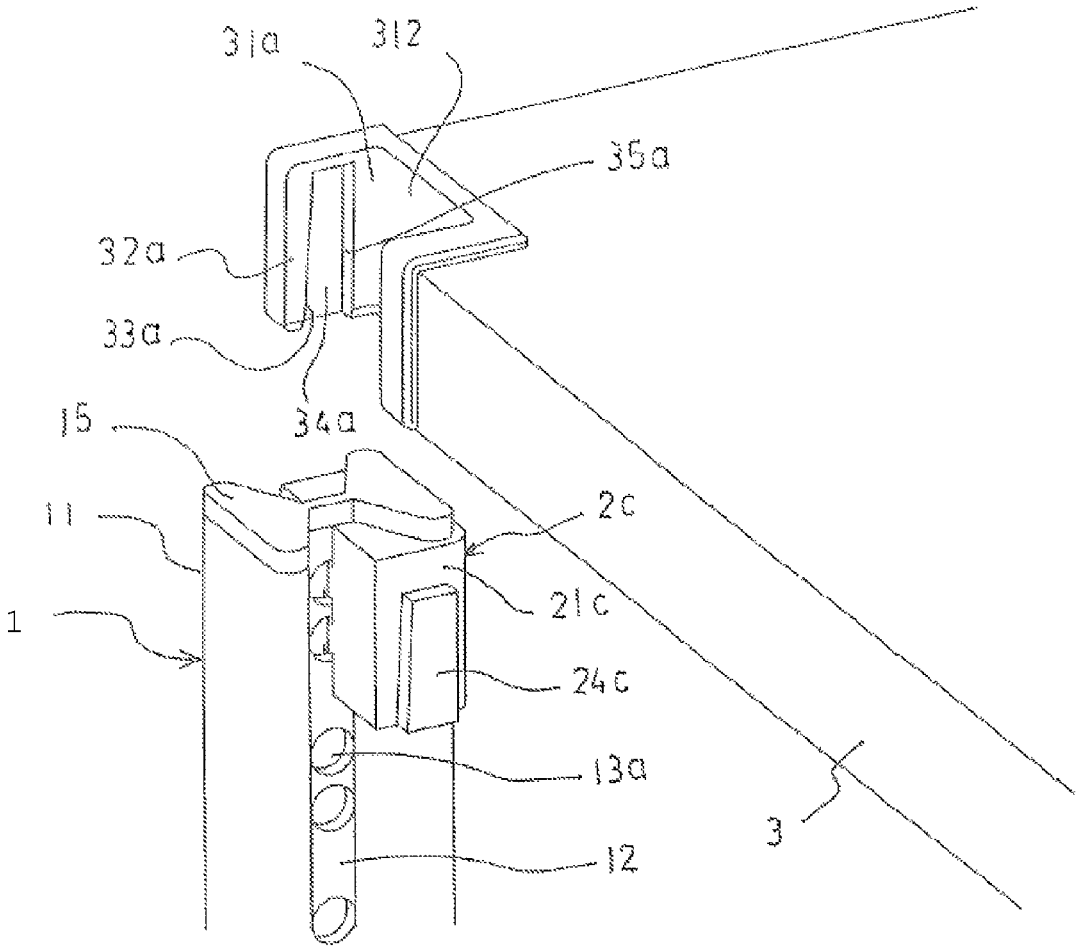
FIG. 8 is a view illustrative of installation of a shelf board member.
Figure 11:
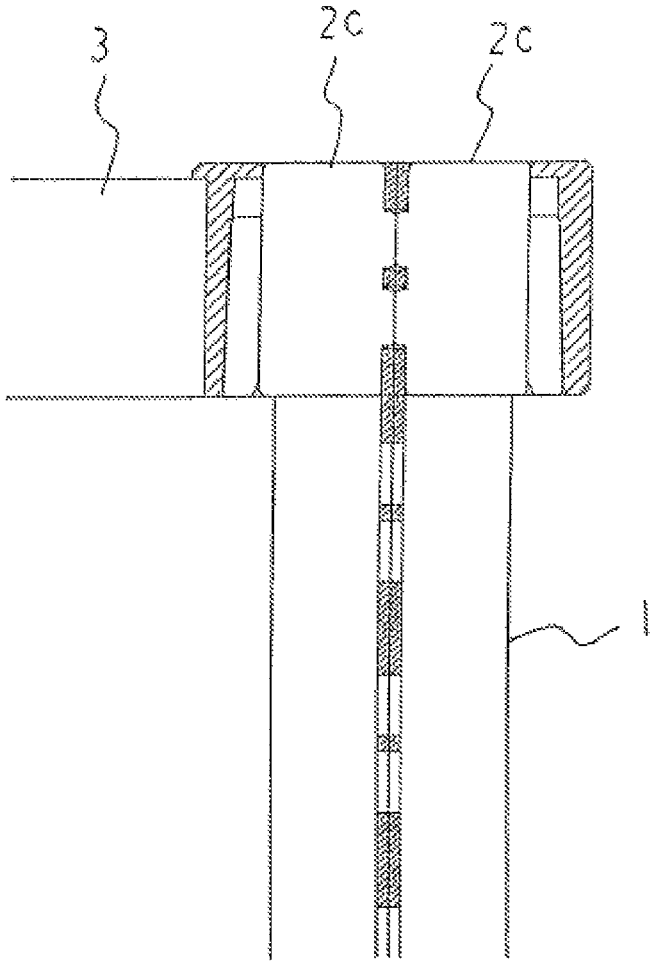
FIG. 11 is a cross-sectional view showing the shelf board member shown in FIG. 9 along the lateral direction.

In FIGS. 6 and 11, elements that have been described with reference to FIGS. 1 and 5 are indicated by identical symbols, and description thereof is omitted. The following description mainly focuses on the features of the second embodiment. An assembly shelf 10*a* shown in FIGS. 6 and 11 mainly differs from the assembly shelf 10 as to the shape of the through-holes formed in the post 1, the shape of a pair of connection members, and the shape of the third engagement section of the shelf board member.

Specifically, round through-holes are formed in the post 1. The round holes are alternately formed at a wide pitch. The through-holes designed in such a manner can also sufficiently deal with a change in the installation position of the shelf board member, and increase the strength of the post.

A pair of connection members 2*c* have a symmetrical shape. The following description appropriately focuses on one of the pair of connection members 2*c*. The connection member 2*c* has a given height (vertical dimension), and is approximately formed in the shape of the letter "C" when viewed from above. The connection member 2*c* includes a depression 22*c* that has a shape corresponding to the shape of a side surface 16*c* of the main post section 11*a*, and a protrusion 23*c* that is positioned adjacent to the depression 22*c* and is inserted into a through-hole 13*a* halfway. Specifically, the first engagement section includes the depression 22*c* that comes in contact with the main post section 11*a*, and the protrusion 23*c* that is inserted into the through-hole 13*a*. The protrusion 23*c* according to this embodiment includes two short arm sections 23*c* that have a semi-circular cross-sectional shape and extend perpendicularly to a backboard 21*c* that is approximately formed in the shape of the letter "C" from one end (i.e., an end that is positioned on the inner side of the post) of the backboard 21*c*. The arm sections 23*c* are fitted into two adjacent through-holes 13*a* within a range that corresponds to half of the through-holes 13*a* in the lateral direction of the post 1 (i.e., the direction perpendicular to the post axis).

A sheet-shaped section (protrusion) (i.e., second engagement section) 24*c* is formed on the outer side of the backboard 21*c* in a lower center area of the backboard 21*c*. The second engagement section 24*c* has a symmetrical shape with respect to a vertical axis that passes through the center of the second engagement section 24*c*. The second engagement section 24*c* includes side slopes 243 that gradually increase in dimension downward, and a rear slope 241 that gradually increases in dimension downward. Note that the inclination angle of the rear slope 241 is lower than that of the side slope 243.

When using the assembly shelf 10*a* according to the second embodiment, the connection members 2*c* are secured on the post 1 as follows. Specifically, the arm sections 23*c* of the connection member 2*c* are inserted into two through-holes 13*a* that are located at positions at which it is desired to install the shelf board member 3, and the depression 22*c* of the connection member 2*c* is fitted onto the side surface 16*c* of the main post section 11*a*. In this case, the end of the arm sections 23*c* is positioned at the middle of the through-holes 13*a* in the insertion direction. Next, the arm sections 23*c* of the other connection member 2*c* are inserted into two through-holes 13*a* that are located at positions at which it is desired to install the shelf board member 3, and the depression 22*c* of the connection member 2*c* is fitted onto the side surface 16*c* of the main post section 11*a*. In this case, the end of the arm sections 23*c* is positioned at the middle of the through-holes 13*a* (i.e., the end of the arm section 23*c* of one connection member 2*c* comes in contact with the end of the arm section 23*c* of the other connection member 2*c*). Almost no opening is formed between the connection members 2*c* and the post 1 (i.e., the connection members 2*c* and the post 1 are joined (integrated)). Specifically, the connection members 2*c* and the post 1 are joined to form a box-shaped body that is formed within a range that covers half of the post 1 in the lateral direction. The sheet-shaped sections (protrusions) 24*c* are provided on either side of the box-shaped body.

A third engagement section 31*a* of the shelf board member 3 is formed by forming a space 312 that receives the box-shaped body formed by the connection members 2*c* and the post 1 by removing the shelf board member 3, and forming a space 34*a* that receives the sheet-shaped section 24*c* on either side of the space 312. Specifically, slopes 32*a* and 35*a* that are respectively formed on the front side and the rear side of each (right or left) small space 34*a* of the third engagement section 31*a* gradually increase in dimension downward, and a side surface 34*a* of the small space 34*a* gradually increases in dimension downward. The third engagement section 31*a* of the shelf board member 3 is formed at an interval from the end face of the shelf board member 1 in the lateral direction. When the third engagement section 31*a* of the shelf board member 3 is fitted onto the second engagement sections 24*c*, the tapered sections of the second engagement sections 24*c* are fitted into the tapered sections of the third engagement section 31*a* so that the third engagement section 31*a* is firmly secured on the second engagement sections 24*c*. The upper wall that defines the depression that forms the small space 34*a* comes in contact with the upper side of the sheet-shaped section 24*c*, so that the downward movement of the shelf board member 3 stops (i.e., the shelf board member 3 is positioned in the vertical direction), and the connection members 2*c* are reliably joined (FIG. The engagement structure formed by the connection members 2*c*, the post 1, and the shelf board member 3 of the assembly shelf 10*a* achieves the same effects as those of the assembly shelf 10. The assembly shelf 10*a* enables a middle shelf board removal operation in the same manner as the assembly shelf 10.

Figure 12:
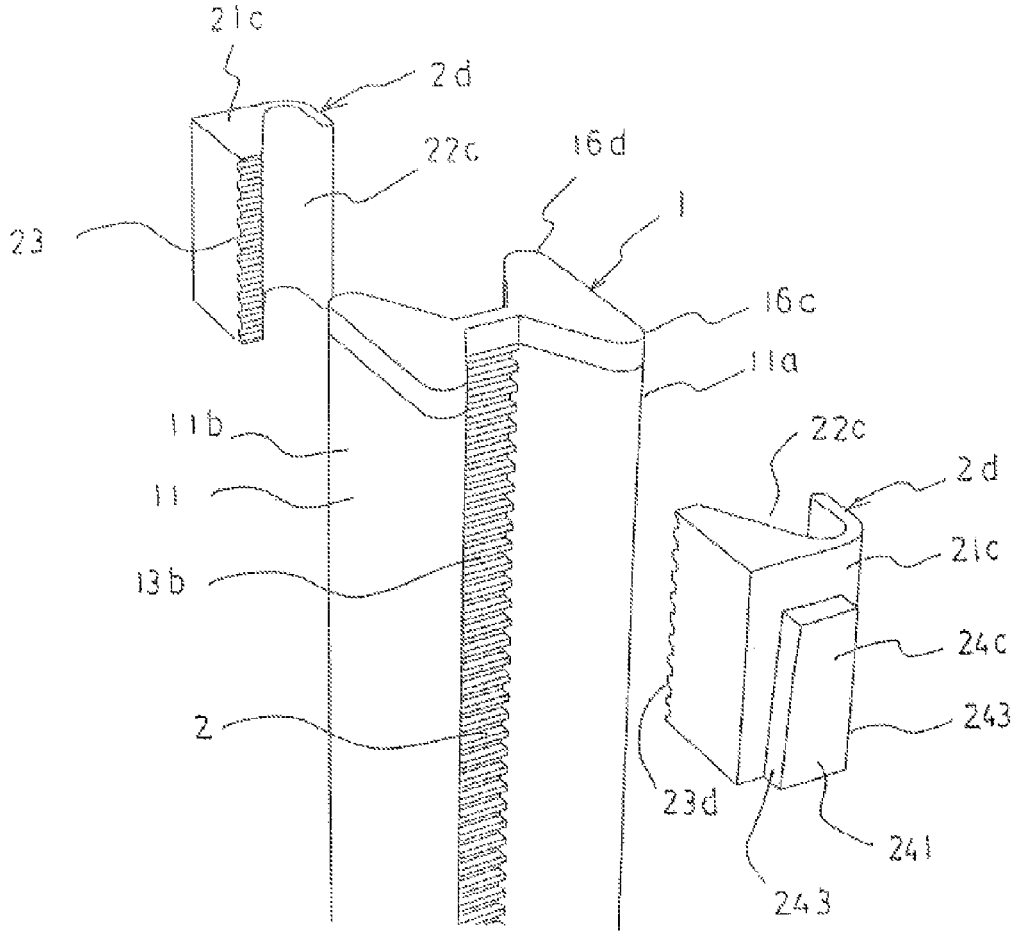
FIG. 12 is a perspective view showing a post and a pair of connection members according to a third embodiment before assembly.
Figure 13:
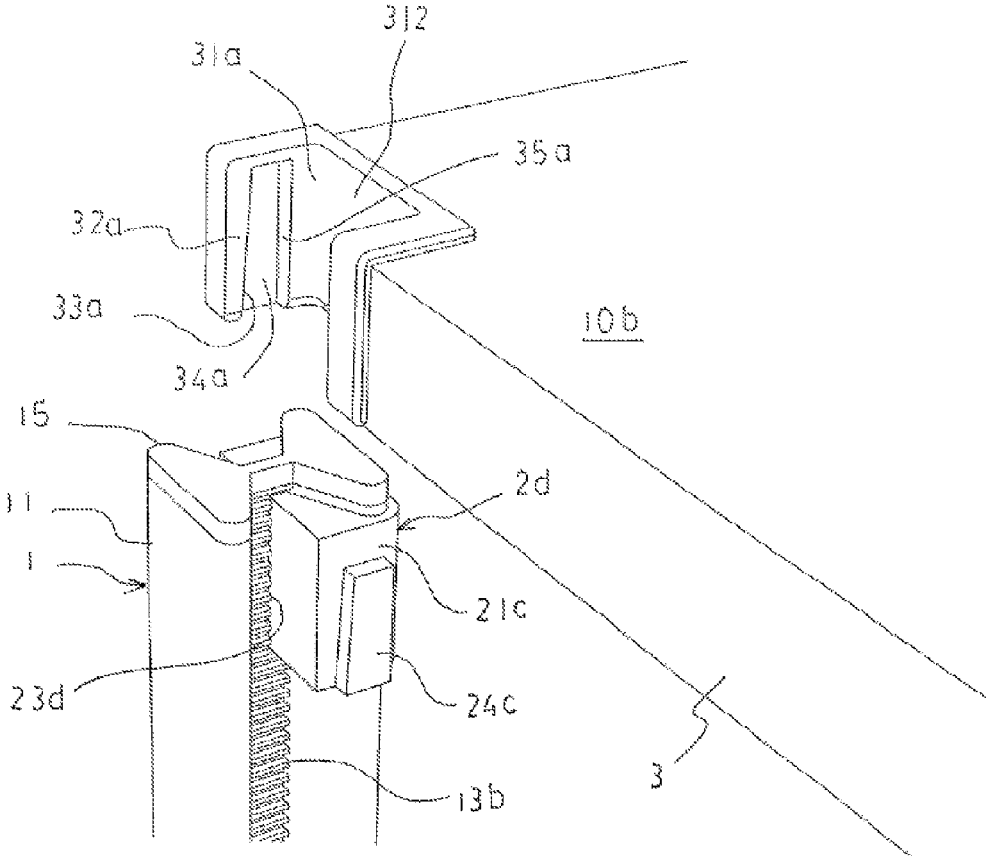
FIG. 13 is a view illustrative of installation of a shelf board member.
Figure 14:
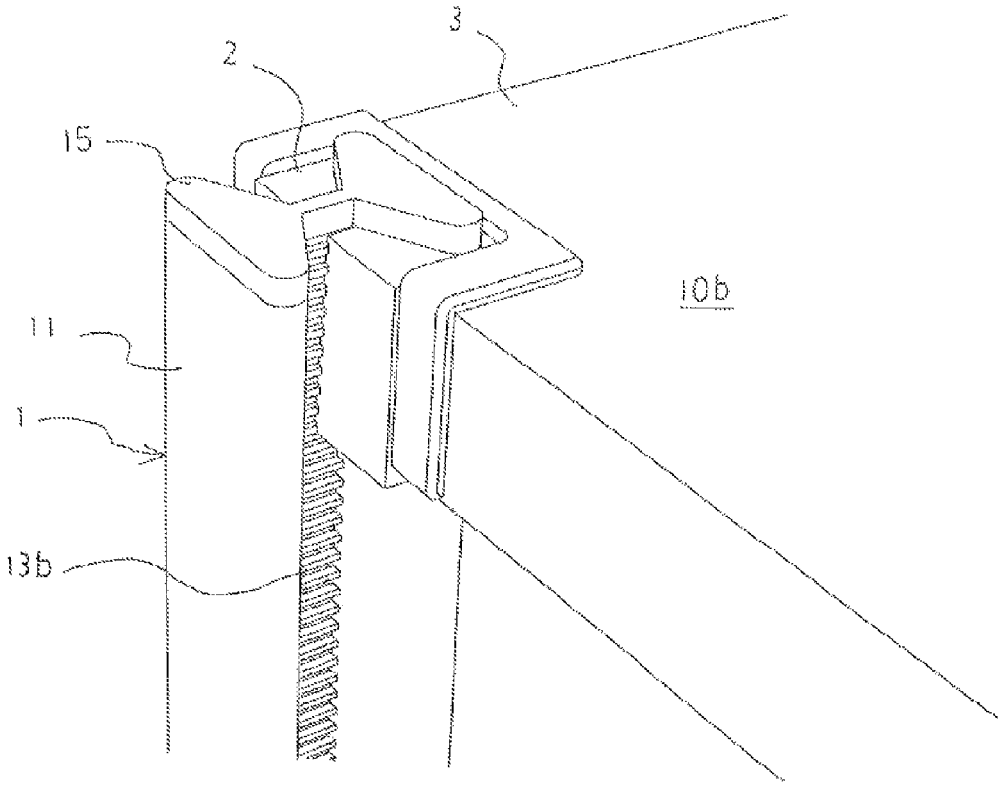
FIG. 14 is an enlarged perspective view showing an engagement area of a post shown in FIG. 8.
Figure 15:
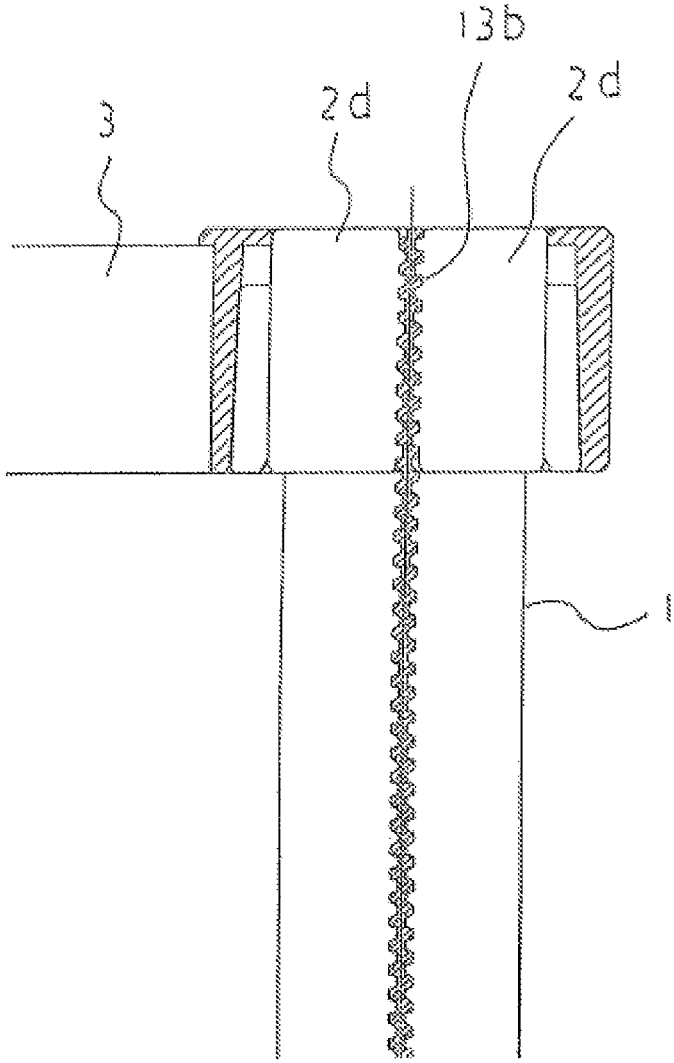
FIG. 15 is a cross-sectional view showing the shelf board member shown in FIG. 14 along the lateral direction.

An assembly shelf according to a third embodiment of the present invention is described below with reference to FIGS. 12 to 15. In FIGS. 12 and 15, elements that have been described with reference to FIGS. 6 and 11 are indicated by identical symbols, and description thereof is omitted. The following description mainly focuses on the features of the third embodiment. An assembly shelf 10*b* mainly differs from the assembly shelf 10*a* as to the shape of the engagement means of the connection section of the post 1 and the shape of a pair of connection members.

The engagement means of the connection section 2 of the post 1 includes engagement elevations and depressions 13*b* that are not formed through the connection section 2. Specifically, the engagement means includes a number of rack-shaped teeth. The teeth are alternately formed on each side of the connection section (i.e., a tooth (protrusion) is formed on one side corresponding to a depression formed in the other side) (see FIG. 15). This makes it possible to increase the strength of the connection section 12 while reducing the thickness of the connection section 12. The shape of the teeth is determined taking account of the stability of engagement with a connection member 2*d*, the strength of the teeth and the connection member 2*d*, and the like. The elevations and depressions designed as described above can also sufficiently deal with a change in the installation position of the shelf board member, and increase the strength of the post.

A pair of connection members 2*d* have an approximately symmetrical shape. The following description appropriately focuses on one of the pair of connection members 2*d*. The connection members 2*d* have a symmetrical shape except that the pitch of engagement elevations and depressions differs by a half pitch in the vertical direction. Specifically, the connection member 2*d* has a given height (vertical dimension), and is approximately formed in the shape of the letter "C" when viewed from above. The connection member 2*d* includes a depression 22*c* that has a shape corresponding to the shape of the side surface 16*c* of the main post section 11*a*, and rack-shaped teeth 23*d* (engagement elevations and depressions) that engage the engagement elevations and depressions 13*b* that are positioned adjacent to the depression 22*c*. Specifically, the first engagement section includes the depression 22*c* that comes in contact with the main post section 11*a*, and the rack-shaped teeth 23*d* that engage the engagement elevations and depressions 13*b*. The rack-shaped teeth 23*d* according to this embodiment include nine teeth that extend perpendicularly to the backboard 21*c* that is approximately formed in the shape of the letter "C" from one end (i.e., an end that is positioned on the inner side of the post) of the backboard 21*c*. The rack-shaped teeth 23*d* engage the engagement elevations and depressions 13*b* of the connection section 12 within a range that corresponds to half of the engagement elevations and depressions 13*b* (connection section 12) in the lateral direction of the post 1 (i.e., the direction perpendicular to the post axis).

When using the assembly shelf 10*b* according to the third embodiment, the connection members 2*d* are secured on the post 1 as follows. Specifically, the rack-shaped teeth 23*d* are fitted into the engagement elevations and depressions 13*b* that are located at positions at which it is desired to install the shelf board member 3, and the depression 22*c* of the connection member 2*c* is fitted onto the side surface 16*c* of the main post section 11*a*. Next, the rack-shaped teeth 23*d* of the other connection member 2*d* are fitted into the engagement elevations and depressions 13*b* that are located at positions opposite to the connection member 2*d* that have been fitted into the engagement elevations and depressions 13*b*, and the depression 22*c* is fitted onto the side surface 16*d* of the main post section 11*a*. The engagement state of the engagement elevations and depressions 13*b* and the rack-shaped teeth 23*d* is maintained due to frictional resistance. Almost no opening is formed between the connection members 2*d* and the post 1 (i.e., the connection members 2*d* and the post 1 are joined (integrated)). Specifically, the connection members 2*d* and the post 1 are joined to form a box-shaped body that is formed within a range that covers half of the post 1 in the lateral direction. The sheet-shaped sections (protrusions) 24*c* are provided on either side of the box-shaped body.

The structure of the third engagement section 31*a* of the shelf board member 3 and a method of installing the shelf board member 3 are the same as described above in connection with the assembly shelf 10*a*. The engagement structure formed by the connection members 2*d*, the post 1, and the shelf board member 3 of the assembly shelf 10*b* achieves the same effects as those of the assembly shelf 10*a* The assembly shelf 10*b* enables a middle shelf board removal operation in the same manner as the assembly shelf 10*a*.

Note that the rack-shaped teeth of the engagement elevations and depressions 13*b* of the assembly shelf 10*b* need not necessarily be formed at a constant (regular) pitch. The rack-shaped teeth may be formed at an irregular pitch, or only some of the rack-shaped teeth may be formed at a constant (regular) pitch.

An assembly shelf according to a fourth embodiment of the present invention is described below with reference to FIGS. 18 to 22. Note that the engagement area shown in FIG. 22 is positioned diagonally with respect to the engagement area shown in FIG. 20.

Figure 18:
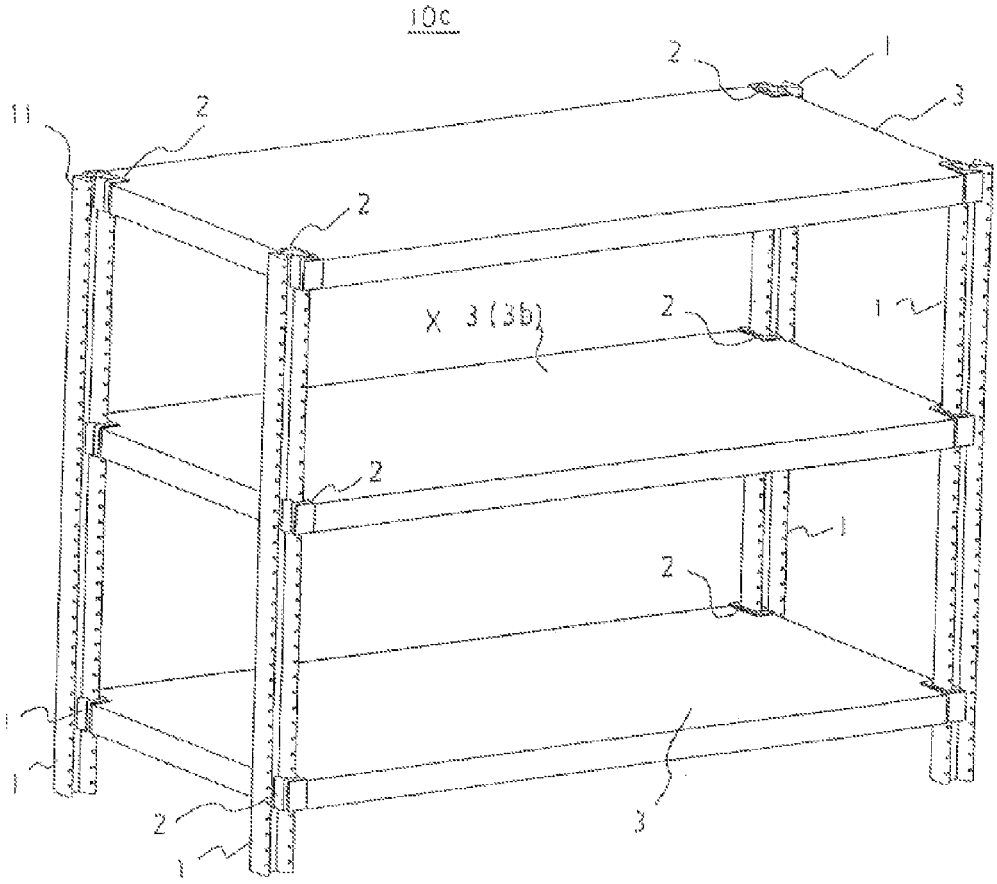
FIG. 18 is a perspective view showing an assembly shelf according to a fourth embodiment.
Figure 22:
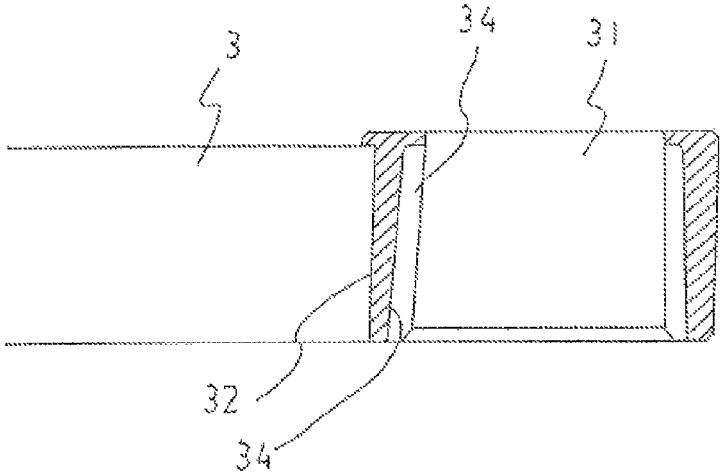
FIG. 22 is a cross-sectional view showing the shelf board member (including a post axis) shown in FIG. 20 along the lateral direction.
Figure 22:
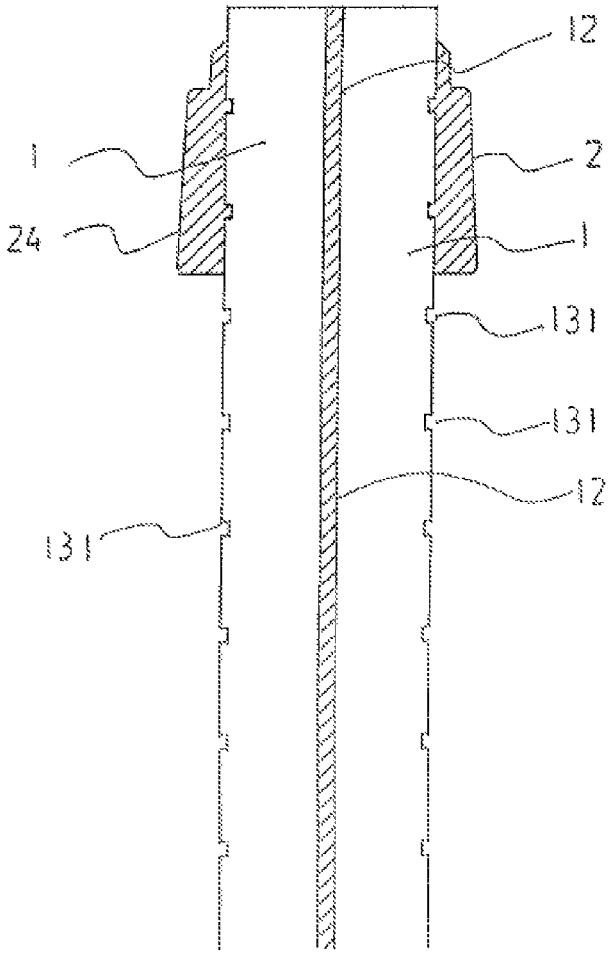

In FIGS. 18 and 22, elements that have been described with reference to FIGS. 1 and 5 are indicated by identical symbols, and description thereof is omitted. The following description mainly focuses on the features of the fourth embodiment. An assembly shelf 10*c* shown in FIGS. 18 to 22 mainly differs from the assembly shelf 10 as to the position and the shape of the engagement elevations and depressions of the post 1, the position and the shape of the engagement elevations and depressions of a pair of connection members, and the shape of the third engagement section of the shelf board member.

The post 1 of the assembly shelf 10*c* includes two main post sections 11 (11*a*, 11*b*) and a connection section 12 that connects the main post sections 11. The post 1 has a symmetrical shape with respect to a post axis (i.e., a virtual vertical axis positioned at the center of the connection section). Specifically, the post 1 has a configuration in which the main post sections 11 (11*a*, 11*b*) and the connection sections 12 are integrated.

A plurality of transverse grooves (engagement depressions) 131 are formed in each side surface (111*a*, 111*b*) of the main post sections 11 (11*a*, 11*b*) along the longitudinal direction (vertical direction) at a regular pitch. Since the transverse grooves (engagement depressions) 131 are formed to the round side surface, the center area and each end of the transverse grooves 131 differ in depth. Each end (depth: 0) of the transverse grooves 131 is continuously formed with the main post section 11. Protrusions 25*a* and 25*b* can reliably engage the transverse grooves 131 (i.e., the shelf board member can be sufficiently supported) insofar as the center area of the transverse grooves 131 has an appropriate depth. The pitch of the transverse grooves (engagement depressions) 131 along the longitudinal direction is appropriately determined depending on the length of the main post section 11 or the application. The depth of the transverse grooves (engagement depressions) 131 is appropriately determined depending on the thickness of the main post section 11 or the weight of articles to be supported.

Figure 19:
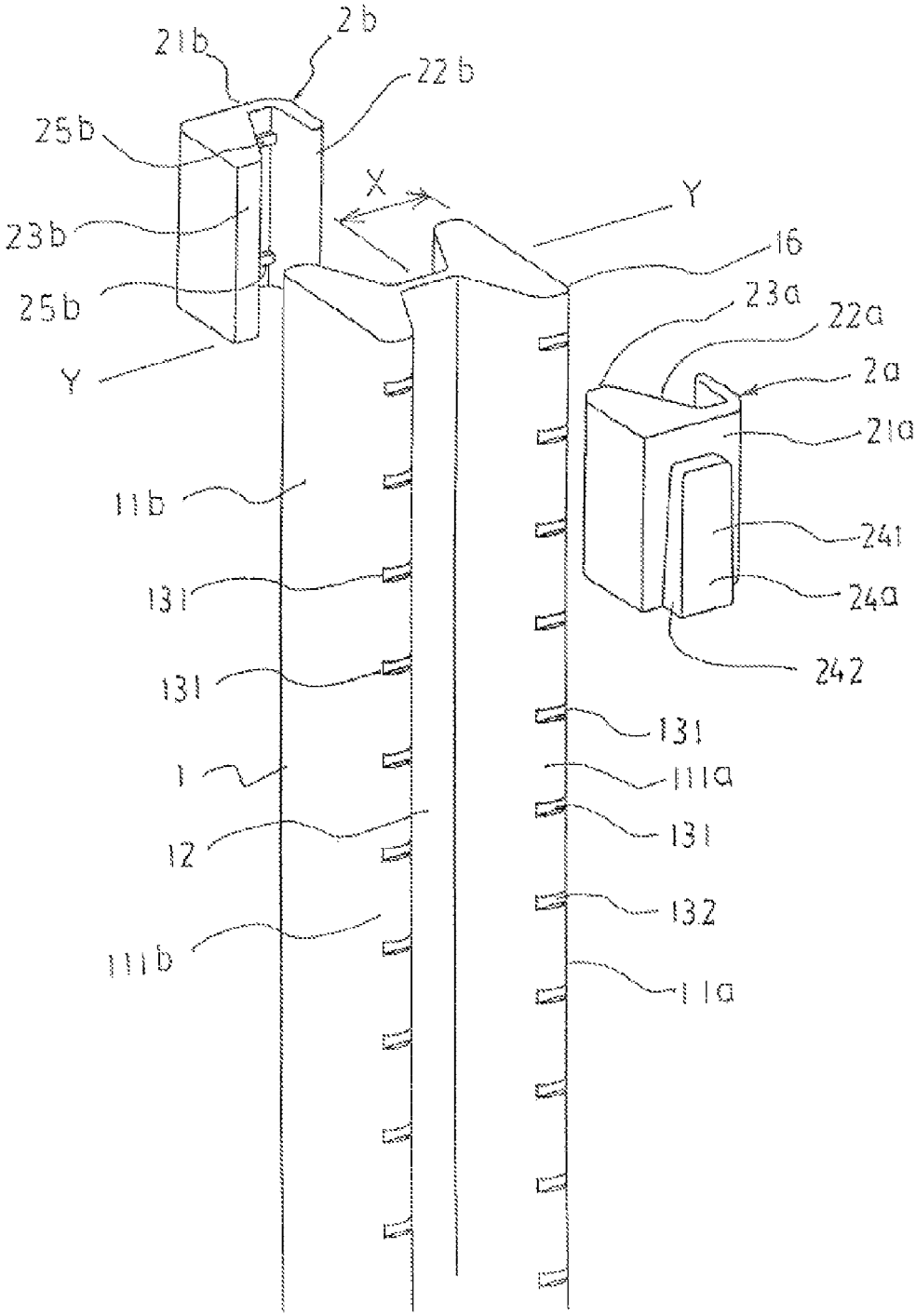
FIG. 19 is a perspective view showing a post and a pair of connection members before assembly according to the fourth embodiment.

The transverse grooves (engagement depressions) 131 respectively formed on the side surfaces 111*a* and 111*b* (i.e., the transverse grooves 131 shown in FIG. 19 and the transverse grooves 131 that are not shown in FIG. 19) are located at opposite positions. A bottom 132 of each transverse groove 131 extends in parallel in the horizontal direction. The transverse grooves 131 formed in the main post section 11*a* and the transverse grooves 131 formed in the main post section 11*b* shown in FIG. 19 are located at identical positions when viewed from the side. The transverse grooves 131 enable installation of the connection member 2, and serve as a guide (standard) for the installation position (height) of the shelf board member.

The connection section 12 is a long plate-like member that has a given width and a given thickness. The thickness of the connection section 12 is appropriately determined so that the post 1 exhibits a sufficient strength. The width (i.e., dimension in the direction along the line Y-Y in FIG. 19) of the connection section 12 is appropriately determined depending on the thickness of arm sections 23*a* and 23*b* that form the first engagement sections 22*a* and 22*b* (connection member 2).

Figure 23:
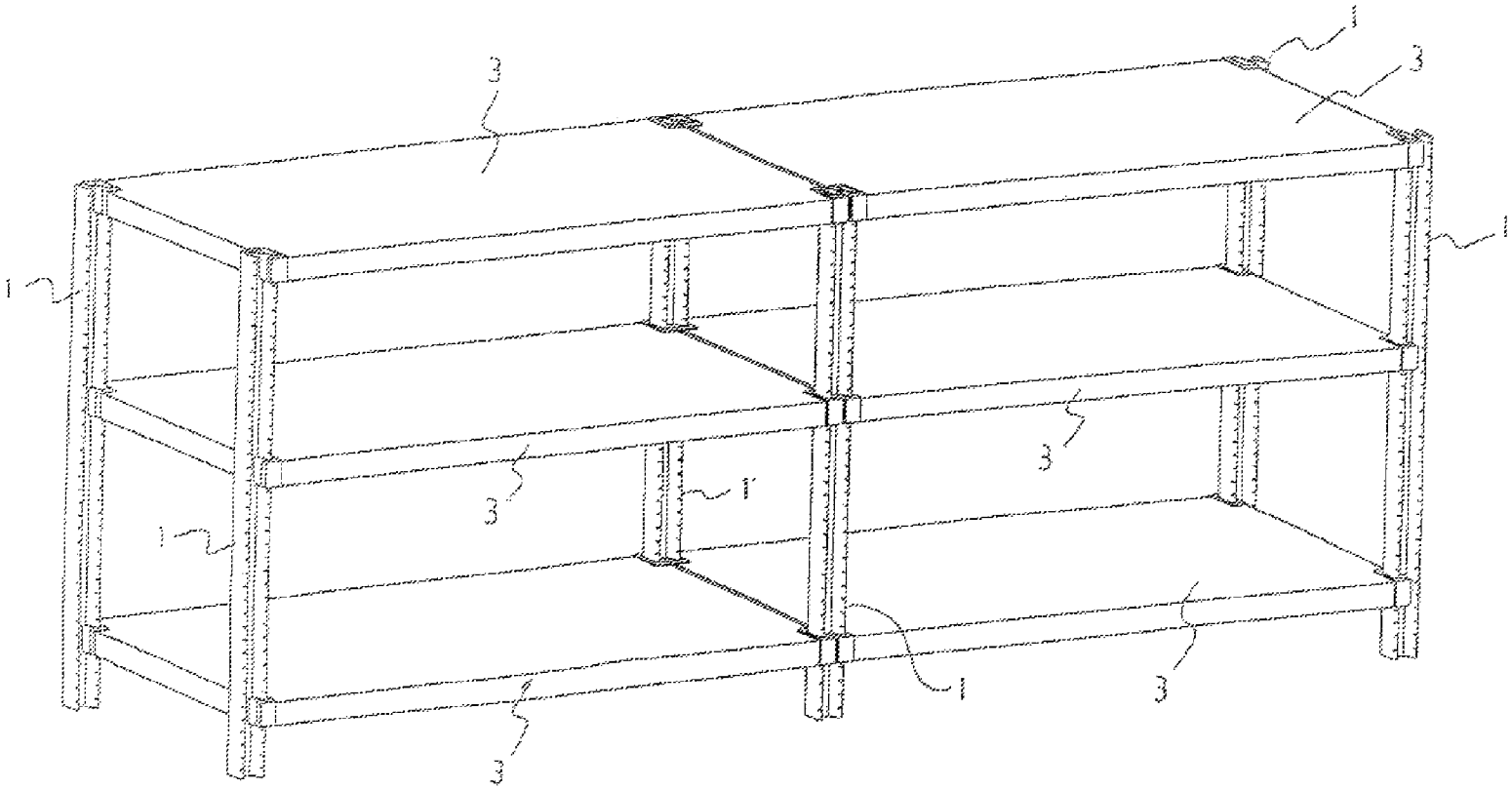
FIG. 23 is a perspective view showing an assembly shelf formed by connecting shelf board members in the longitudinal direction.

The assembly shelf 10*c* shown in FIG. 18 forms one unit (normally a multi-stage unit). A pair of connection members 2 and the shelf board member 3 are secured on the post 1 within a range that corresponds to half of the post 1 in the lateral direction (i.e., a direction along the line Y-Y in FIG. 19 (longitudinal direction when viewed from above). Specifically, a pair of connection members 2 and the shelf board member 3 are disposed within a range (i.e., a range X shown in FIG. 19) that covers one main post section 11*a* and half of the connection section 12 in the direction along the line Y-Y. Therefore, when connecting two assembly shelves 10*c* in the direction along the line Y-Y, one post 1 can be shared when securing the right and left shelf board members 3 and 3 (see FIGS. 21 and 23).

Each of a pair of connection members 2*a* and 2*b* includes a first engagement section that engages the post 1, and a second engagement section that engages the shelf board member 3, and is installed so that the connection members 2*a* and 2*b* hold either side of the post 1 by utilizing half of the post 1 in the lateral direction. The connection members 2*a* and 2*b* have a symmetrical shape. The following description appropriately focuses on one of the connection members 2*a* and 2*b*. The connection member 2*a* has a given height (vertical length), and is approximately formed in the shape of the letter "C" when viewed from above. The connection member 2*a* includes a depression 22*a* that has a shape corresponding to the shape of a side surface 16 of the main post section 11*a*, a protrusion 25*a* that is formed on the inner wall of the depression 22*a* and is fitted into the transverse groove 131, and an inner arm section 23*a* that forms the depression 22*a* and has a dimension sufficient to come in contact with the connection section 12. Specifically, the first engagement section includes the depression 22*a* that comes in contact with the side surface of the main post section 11*a*, the protrusion 25*a*, and the inner arm section 23*a*. The arm sections 23*a* and 23*b* come in contact with, or are positioned close to, the connection section 12. The area of the arm sections 23*a* and 23*b* that comes in contact with, or is positioned close to, the connection section 12 is positioned within a range that corresponds to half of the connection section 12 in the lateral direction of the post 1 (i.e., the direction perpendicular to the post axis).

The protrusion 25*a* is integrally formed with the connection member 2*a*. The protrusion 25*a* engages the transverse groove 131 formed in the main post section 11 so that the connection member 2 engages the post 1. The protrusion 25*a* has a rectangular cross-sectional shape. The protrusion 25*a* is formed in the shape of a rod that extends in the direction along the line Y-Y. Note that the protrusion 25*a* is not shown in FIG. 19.

A sheet-shaped section (protrusion) (i.e., second engagement section) 24*a* is formed on the outer side of the backboard 21*a* at a lower center position. The second engagement section 24*a* is the same as the second engagement section 24*c* according to the second embodiment. Therefore, description thereof is omitted.

A sheet-shaped section (protrusion) (i.e., second engagement section) 24*b* (not shown) is formed on the outer side of the backboard 21*b* in the same manner as the connection member 2*a*. The shape of the second engagement section 24*b* is the same as that of the second engagement section 24*a* of the connection member 2*a*. The height of the connection members 2*a* and 2*b* (i.e., vertical dimension) is approximately the same as the height (i.e., thickness) of the shelf board member 3.

Figure 20:
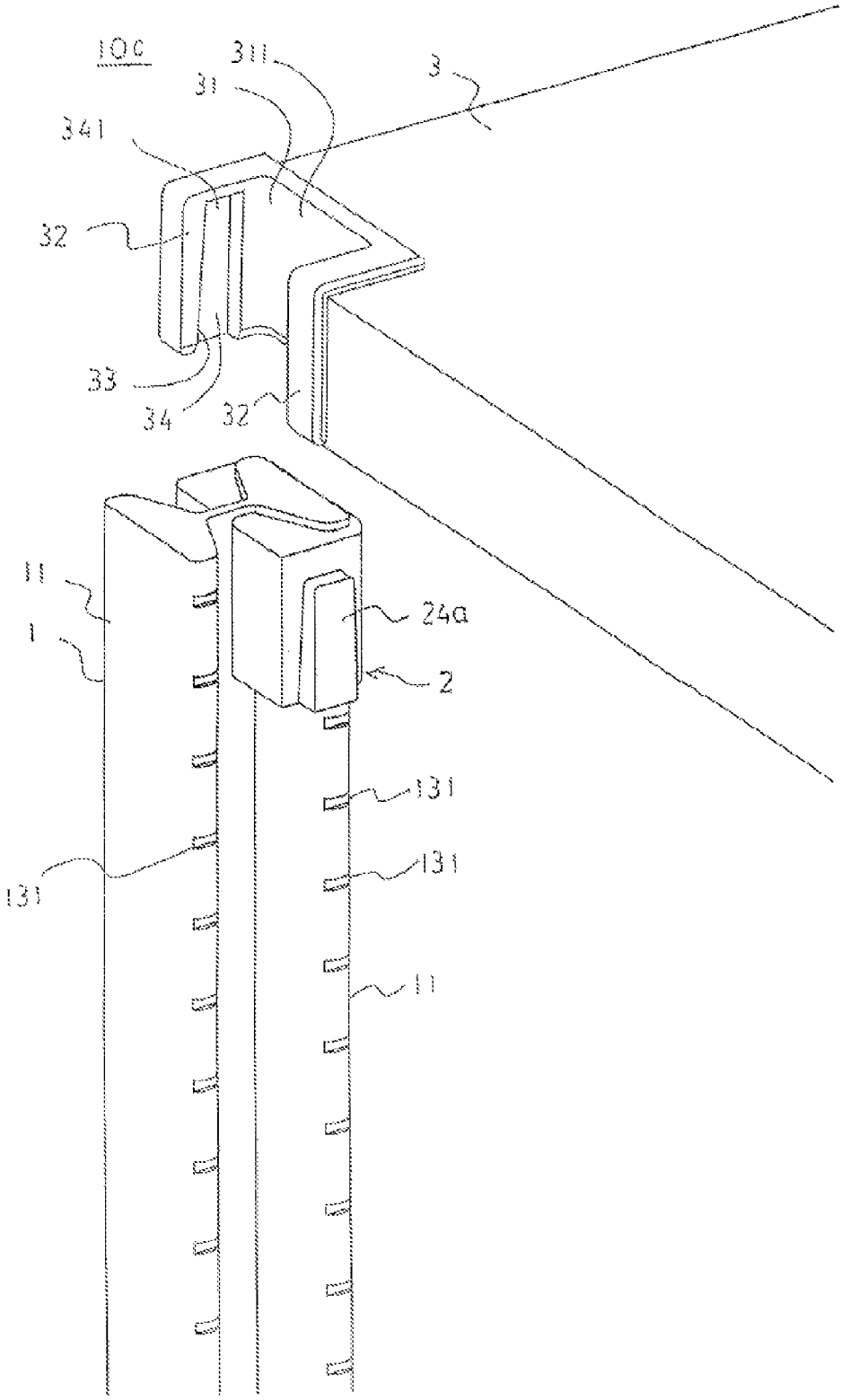
FIG. 20 is a view illustrative of state before installing a shelf board member.
Figure 21:
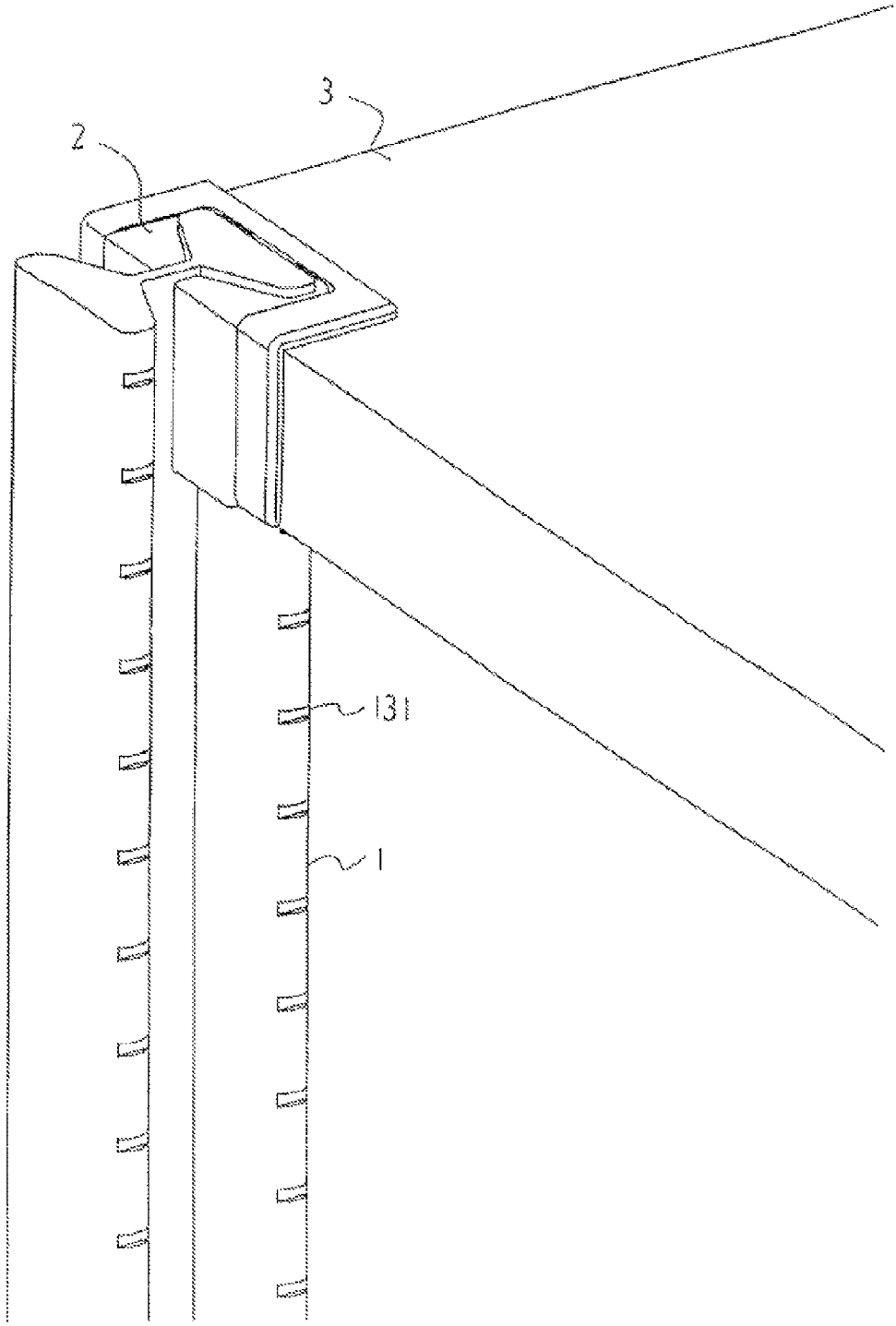
FIG. 21 is a view illustrative of a state after a shelf board member has been installed.

The connection members 2*a* and 2*b* are secured on the post 1 as follows. Specifically, the connection member 2*a* is moved so that the protrusions 25*a* and 25*b* of the connection members 2*a* and 2*b* are fitted into two transverse grooves 131 that are located at positions at which it is desired to install the shelf board member 3, and the depression 22*a* of the connection member 2*a* is fitted onto the side surface 16 of the main post section 11*a*. Next, the connection member 2*b* is attached to the main post section 11*b* in the same manner as described above so that the connection members 2*a* and 2*b* are joined (FIG. 20). Almost no opening is formed between the connection members 2*a* and 2*b* and the post 1 (i.e., the connection members 2*a* and 2*b* and the post 1 are joined (integrated)). Specifically, the connection members 2*a* and 2*b* and the post 1 are joined to form a box-shaped body that is formed within a range that covers half of the post 1 in the lateral direction.

The sheet-shaped sections (protrusions) 24*a* and 24*b* are provided on either side of the box-shaped body.

The third engagement section 31 of the shelf board member 3 is the same as the third engagement section 31 of the shelf board member 3 according to the second embodiment. Therefore, description thereof is omitted.

Figure 24:
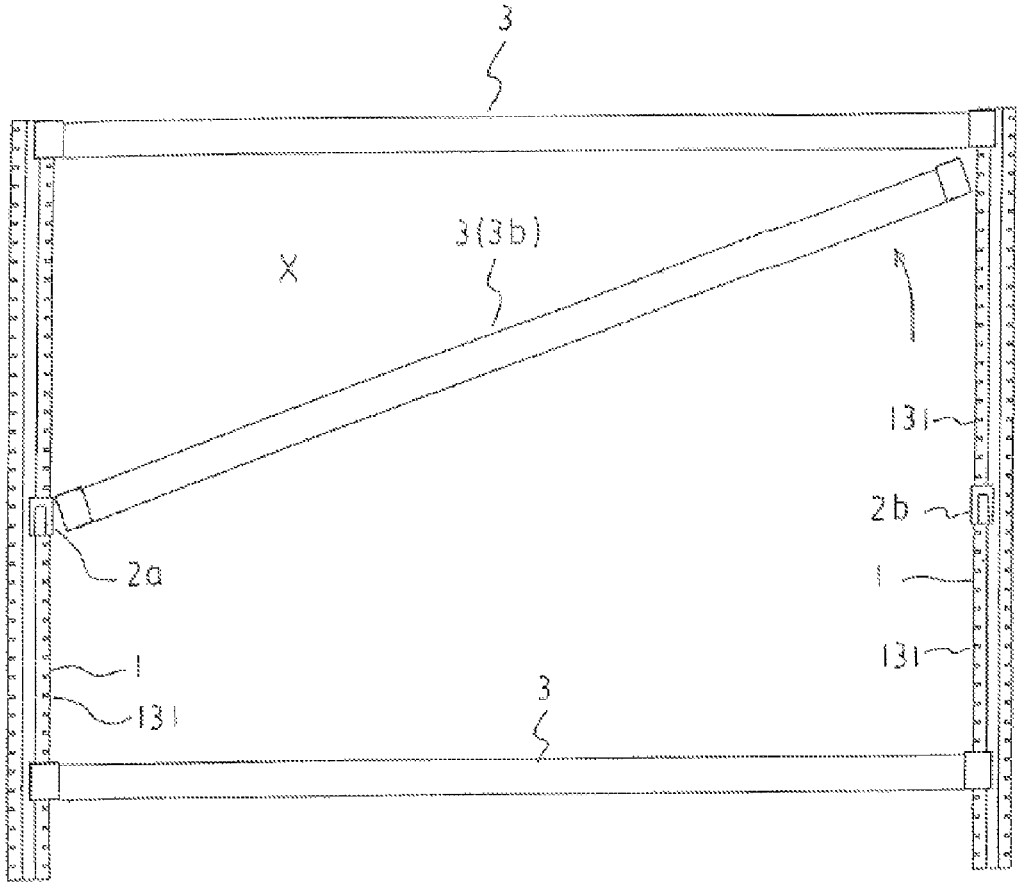
FIG. 24 is a view illustrative of a middle shelf board removal operation.
Figure 25:
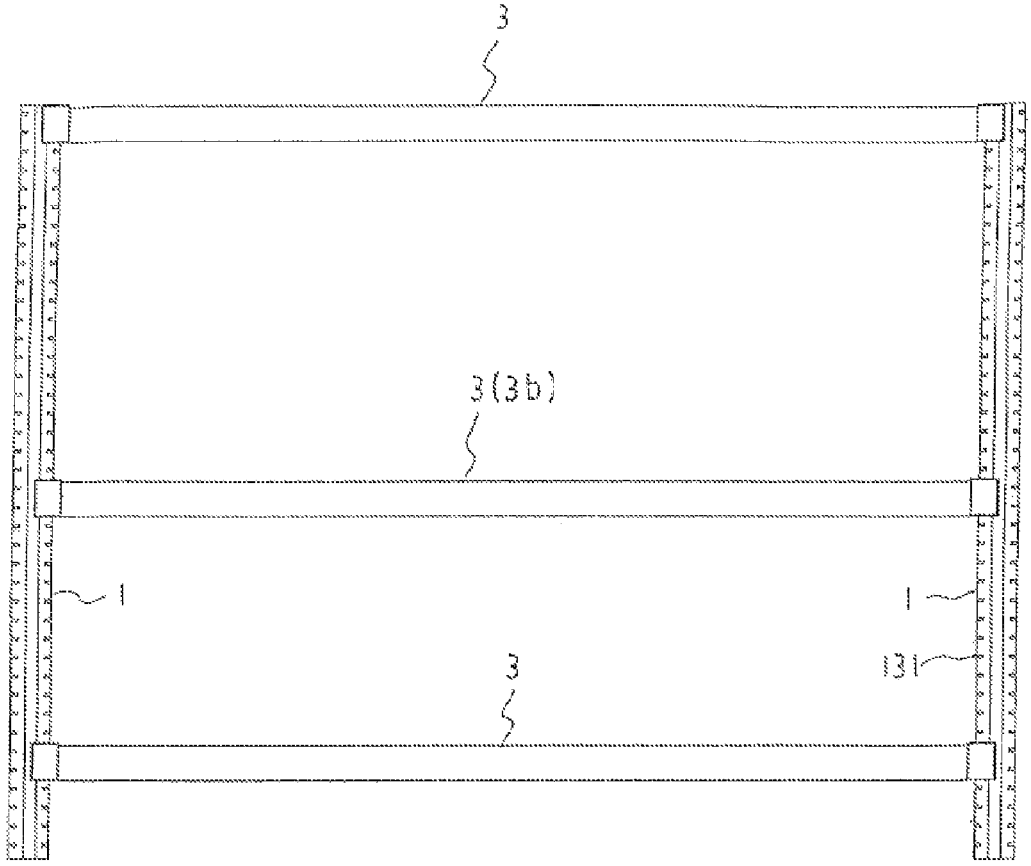
FIG. 25 is a view showing a state in which a middle shelf board has been reinstalled after a middle shelf board removal operation.

A case of removing a middle shelf board member 3*b* of the assembly shelf 10*c*, or changing the installation position of the middle shelf board member 3*b* (i.e., middle shelf board removal operation) is described below with reference to FIGS. 18, 24, and 25. As shown in FIG. 24, the middle shelf board member 3*b* is moved upward in order to remove the middle shelf board member 3*b*. An obstacle that may hinder the movement of the middle shelf board member 3*b* is not present in a space X above the middle shelf board member 3*b*, and a sufficient space is formed between the post 1 and the third engagement section 31 of the shelf board member 3 at a position where the connection member 2*a* or 2*b* is not secured on the post 1. When the middle shelf board member 3*b* has been moved upward to some extent, the middle shelf board member 3*b* is inclined upward or downward along the longitudinal direction (see FIG. 24). The middle shelf board member 3*b* is inclined so that the horizontal dimension of the inclined middle shelf board member 3*b* is smaller than the distance between the posts 1 of the assembly shelf 10*c*. The middle shelf board member 3*b* thus inclined is then removed forward from the assembly shelf 10. After removing the middle shelf board member 3*b*, the connection members 2*a* and 2*b* may be removed from the assembly shelf 10, and may optionally be secured at different positions of the assembly shelf 10. The middle shelf board member 3*b* may be installed by performing the above steps in the reverse order. FIG. 25 shows a state in which the middle shelf board member 3*b* has been reinstalled. The assembly shelve 10*c* thus allows an easy middle shelf board removal operation.

Note that the assembly shelf according to the present invention is not limited to the above embodiments. Various modifications may be made of the assembly shelf according to the present invention. For example, the main post section 11 may have a circular cross-sectional shape, an elliptical cross-sectional shape, a triangular cross-sectional shape, or the like instead of an approximately pentagonal shape. The protrusion 24 (engagement protrusion) may be formed on the main post section 11, and the transverse grooves 131 may be formed in the connection member 2 instead of employing the above engagement configuration. The shape of the engagement depression and the engagement protrusion is not limited to the transverse groove or a rod-like member having a rectangular cross-sectional shape. Engagement may be implemented using a round groove and a round protrusion, an elliptical groove and an elliptical protrusion, or the like.

INDUSTRIAL APPLICABILITY

The assembly shelf according to the present invention may be used in an office, home, warehouse, store, and the like, or may be used as a display shelf that is installed in a store, and implements easy assembly and disassembly.

The invention claimed is:

1. An assembly shelf comprising:

a post that includes two main post sections and a plate connection section that connects the two main post sections, the post having a symmetrical shape with respect to a post axis, a plurality of engagement elevations and depressions being formed in the plate connection section along a longitudinal direction at regular intervals, wherein the two main post sections and the connection section do not form a hollow tube;

a pair of connection members, each of the pair of connection members including a first engagement section that engages the post, and a second engagement section that engages a shelf board member, the pair of connection members being attached to hold either side of the post in a lateral direction of the shelf board member such that the pair of connection members are attached to the post in only half of a lateral dimension of the post; and the shelf board member includes a third engagement section that is formed approximately at each corner and engages with the second engagement section, an end of the shelf board member in a longitudinal direction being positioned to extend to only half of the post in the lateral direction of the post, wherein the first engagement section includes a depression that has a shape corresponding to a shape of one side surface of one of the two main post sections, and engagement elevations and depressions that engage the plurality of engagement elevations and depressions of the plate connection section.

2. The assembly shelf according to claim 1, wherein the plurality of engagement elevations and depressions of the plate connection section are rack-shaped teeth, and the engagement elevations and depressions included in the first engagement section are rack-shaped teeth that engage the plurality of engagement elevations and depressions.

3. The assembly shelf according to claim 1, wherein the second engagement section is a protrusion that includes a slope that gradually increases in dimension downward.

4. The assembly shelf according to claim 1, wherein the third engagement section includes a depression that has a slope that gradually increases in dimension downward.

5. The assembly shelf according to claim 1, wherein an additional shelf board member and additional connection members having the same shape as defined in claim 1 are fitted to the remaining half area of the post in the lateral direction so that the shelf board member and the additional shelf board member are connected via the post.

6. An assembly shelf comprising:

a post that includes two main post sections and a connection section that connects the two main post sections, the connection section being disposed substantially between a center portion of each of the two main post sections, the post having a symmetrical shape with respect to a post axis, a plurality of alternating engagement elevations and depressions being formed in the connection section along a longitudinal direction at regular intervals, wherein the two main post sections and the connection section do not form a hollow tube;

a pair of connection members, each of the pair of connection members including a first engagement section that engages the post, and a second engagement section that engages a shelf board member, the pair of connection members being attached to hold either side of the post in a lateral direction of the shelf board member such that the pair of connection members are attached to the post in only half of a lateral dimension of the post; and the shelf board member includes a third engagement section that is formed approximately at each corner and engages with the second engagement section, an end of the shelf board member in a longitudinal direction being positioned to extend to only half of the post in the lateral direction of the post, wherein the first engagement section includes a depression that has a shape corresponding to a shape of one side surface of one of the two main post sections, and a plurality of alternating engagement elevations and depressions that engage the plurality of alternating engagement elevations and depressions of the connection section.

7. The assembly shelf according to claim 6, wherein the plurality of alternating engagement elevations and depressions of the connection section are rack-shaped teeth, and the plurality of alternating engagement elevations and depressions included in the first engagement section are rack-shaped teeth that engage the plurality of alternating engagement elevations and depressions of the connection section.

8. The assembly shelf according to claim 6, wherein the second engagement section is a protrusion that includes a slope that gradually increases in dimension downward.

9. The assembly shelf according to claim 6, wherein the third engagement section includes a depression that has a slope that gradually increases in dimension downward.

10. The assembly shelf according to claim 6, wherein an additional shelf board member and additional connection members having the same shape as defined in claim 6, are fitted to the remaining half area of the post in the lateral direction so that the shelf board member and the additional shelf board member are connected via the post.

* * * * *